US008197250B2

(12) United States Patent
Morgan et al.

(10) Patent No.: US 8,197,250 B2
(45) Date of Patent: Jun. 12, 2012

(54) ADJUSTABLE BURNERS FOR HEATERS

(75) Inventors: Edward R. Morgan, Elk Grove Village, IL (US); Kenneth D. Peters, Elmhurst, IL (US); Dennis M. Clary, Barrington, IL (US)

(73) Assignee: UOP LLC, Des Plaines, IL (US)

( * ) Notice: Subject to any disclaimer, the term of this patent is extended or adjusted under 35 U.S.C. 154(b) by 447 days.

(21) Appl. No.: 12/435,736

(22) Filed: May 5, 2009

(65) Prior Publication Data

US 2010/0248169 A1 Sep. 30, 2010

Related U.S. Application Data

(60) Provisional application No. 61/165,108, filed on Mar. 31, 2009.

(51) Int. Cl.
*F23C 5/06* (2006.01)

(52) U.S. Cl. ..... 431/189; 431/9

(58) Field of Classification Search ..... 431/8, 9, 431/189

See application file for complete search history.

(56) References Cited

U.S. PATENT DOCUMENTS

| | | | | | |
|---|---|---|---|---|---|
| 1,064,251 | A | | 6/1913 | Pring | |
| 1,722,225 | A | | 7/1929 | Jupin | |
| 2,021,245 | A | * | 11/1935 | Tonnar | 432/195 |
| 2,109,840 | A | * | 3/1938 | Gordon | 122/459 |
| 2,396,200 | A | * | 3/1946 | Praeger | 122/356 |
| 2,523,971 | A | * | 9/1950 | Schutt | 122/356 |
| 2,625,140 | A | * | 1/1953 | Weir | 122/333 |
| RE24,119 | E | * | 2/1956 | Armacost | 122/479.1 |
| 3,439,912 | A | * | 4/1969 | Berger | 266/226 |
| 3,841,274 | A | * | 10/1974 | Barnes | 122/356 |
| 4,302,179 | A | | 11/1981 | Pont | |
| 4,483,672 | A | | 11/1984 | Wallace et al. | |
| 4,525,139 | A | | 6/1985 | Bleimann et al. | |
| 4,999,089 | A | * | 3/1991 | Nakase et al. | 196/110 |
| 5,461,990 | A | * | 10/1995 | Newman | 110/261 |
| 5,878,739 | A | | 3/1999 | Guidry | |
| 7,531,146 | B2 | * | 5/2009 | Gorval | 422/625 |
| 2007/0128091 | A1 | * | 6/2007 | Gorval | 422/197 |

FOREIGN PATENT DOCUMENTS

| | | | |
|---|---|---|---|
| JP | 47018709 | A * | 9/1972 |
| JP | 62084213 | A | 4/1987 |

OTHER PUBLICATIONS

Miesse, "Effects of Heat Transfer and Flame Stretch in Microcombustors," 2005 AIChE Spring National Meeting, Conference Proceedings, 2005, p. 2671 (abstract only).

Davydov,"Investigation", Combustion, Explosion, and Shock Waves (English Translation of Fizika Goreniya i Vzryval),May-Jun. 1978, vol. 14, No. 3, pp. 334-337(abstract only)

* cited by examiner

*Primary Examiner* — Kenneth Rinehart
*Assistant Examiner* — Jorge Pereiro
(74) *Attorney, Agent, or Firm* — Maryann Maas

(57) ABSTRACT

Disclosed are heaters having at least one adjustable fired burner and an adjustable fired burner for use with various types of heaters. The heaters may be part of an industrial processes such as petroleum refining. The adjustable burners are configured to be adjusted and positioned in any direction and then be locked into place. The adjustable burners may be adjusted automatically or manually. The ability to quickly adjust the position of an adjustable burner results in substantially less or virtually no damage to elements in the heater and provides for a more even distribution of heat within the heater.

24 Claims, 14 Drawing Sheets

ADJUSTABLE BURNERS FOR HEATERS

CROSS-REFERENCE TO RELATED APPLICATION

This application claims priority from Provisional Application Ser. No. 61/165,108 filed Mar. 31, 2009, the contents of which are hereby incorporated by reference in its entirety.

FIELD OF THE INVENTION

The disclosure relates to fired heaters or furnaces for use in industry such as oil refineries and petrochemical plants. More particularly, it relates to fired heaters used in such furnaces, with adjustable burners.

DESCRIPTION OF RELATED ART

Fired heaters or furnaces used in industrial processes such as in oil refining and petrochemical plants may be arbor or wicket type, U-tube, single or double I-coil, W-coil, Y-coil, vertical cylindrical, vertical cylindrical with cross-tube convection, vertical tube box heater, horizontal tube cabin, serpentine or the like.

Each of these heaters has at least one channel that carries a process stream such as hydrogen and/or hydrocarbons, inert gas or other process fluid including entrained solids. Positioned adjacent to the channel is at least one burner that produces a flame or flames, which heat the channel. The channel provides a radiant heating surface for heating the process stream. The process stream is heated to raise the temperature of the stream for further processing downstream or to promote chemical or thermal reactions in the channels.

The flames are subject to movement caused by internal flue-gas box currents due to unequal firing between different heater cells or the thermal gradients due to the process stream temperature differentials inside the channels. The flames are also subject to environmental conditions such as wind which causes the flames to "lean" more toward one direction or side than the other. Environmental conditions also produce internal box currents. For example, wind or air currents may blow the flames such that the flames move off center and, therefore, disproportionally heat one portion of the channel.

This disproportional heating may cause the process to suffer from decreased performance. In particular, flame impingement directly on the tube surface can cause coking due to localized heating. Such coking may reduce the heat transfer through the tube. In addition, this coking may damage the channel, cause shorter channel life, cause fouling inside the channel, cause increased channel corrosion, excessive use of fired fuel, or even an unplanned shutdown from channel failure. Channel failure can result in an undesirable release of process fluids into the environment. This loss of process containment can result in fires and explosions. There is a need for a fired heater that allows for easy adjustment of the heat source or flame relative to the channels to account for unpredictable internal flue gas box currents and environmental conditions.

SUMMARY OF THE INVENTION

This disclosure applies to heaters for industrial processes, for example, fired heaters. In one version, the disclosure provides a fired heater for industrial processes comprising at least one channel carrying a process stream. The channel has at least one inlet terminal and at least one outlet terminal. The fired heater also comprises at least one burner producing a flame for heating the channel. The at least one burner is configured to be adjustable between a neutral position and an adjusted position. Changing the position of the burner changes the position of the flame relative to the walls, floor or channel and allows a user to account for environmental conditions and flue gas currents within the heater, thus providing for more uniform heating of the channel and process stream therein.

The disclosure also provides a fired heater comprising a channel carrying at least one stream of material. The heater comprises a base and at least one wall. The base and at least one wall provide at least one burner mounting surface. The heater also comprises a chamber within at least one mounting surface and an adjustable burner. The burner comprises at least one fuel pipe in communication with at least one fuel source. The burner is configured to produce a flame from an end of the fuel pipe. The adjustable burner may be adjacent the channel. The heater also comprises at least one burner adjustment mechanism comprising at least one rotatable turntable coupled to at least one mounting surface, at least one connector, at least one rotatable support. The at least one connector may be coupled to the turntable and the at least one rotatable support. The at least one rotatable support may be coupled to the burner. Rotation of the at least one turntable adjusts the position of the adjustable burner.

DETAILED DESCRIPTION

Figure 1B:
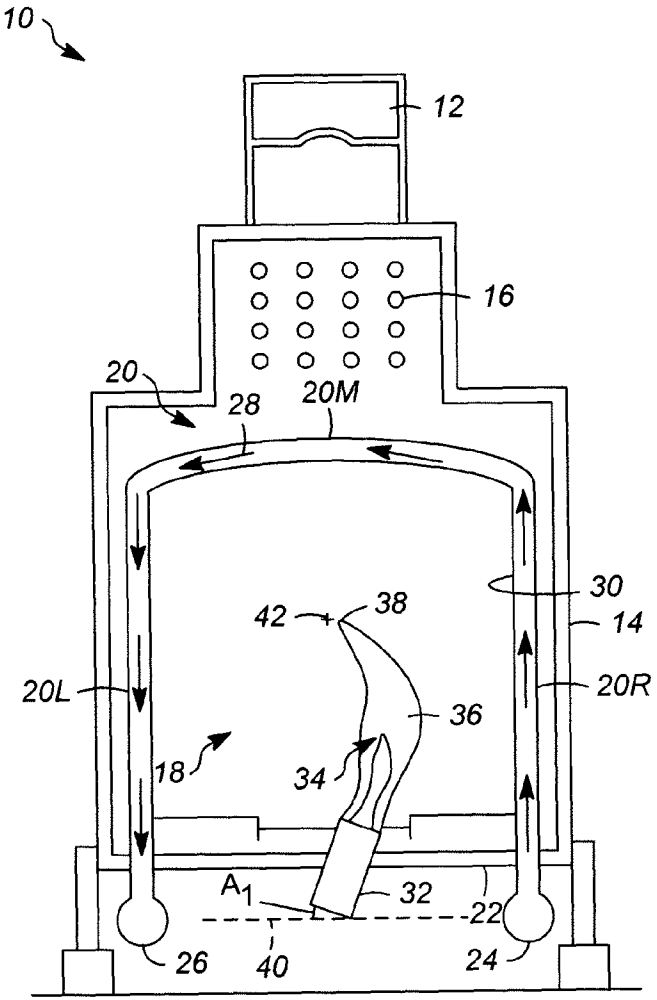
FIG. 1B is a front view of the version of the heater shown in FIG. 1A with the position of the adjustable burner adjusted.
Figure 1A:
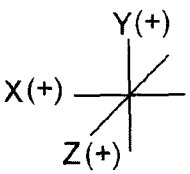
FIG. 1A is a front view of a version of a heater having at least one arbor-type channel and an adjustable burner, with the adjustable burner in the first position.
Figure 1A:
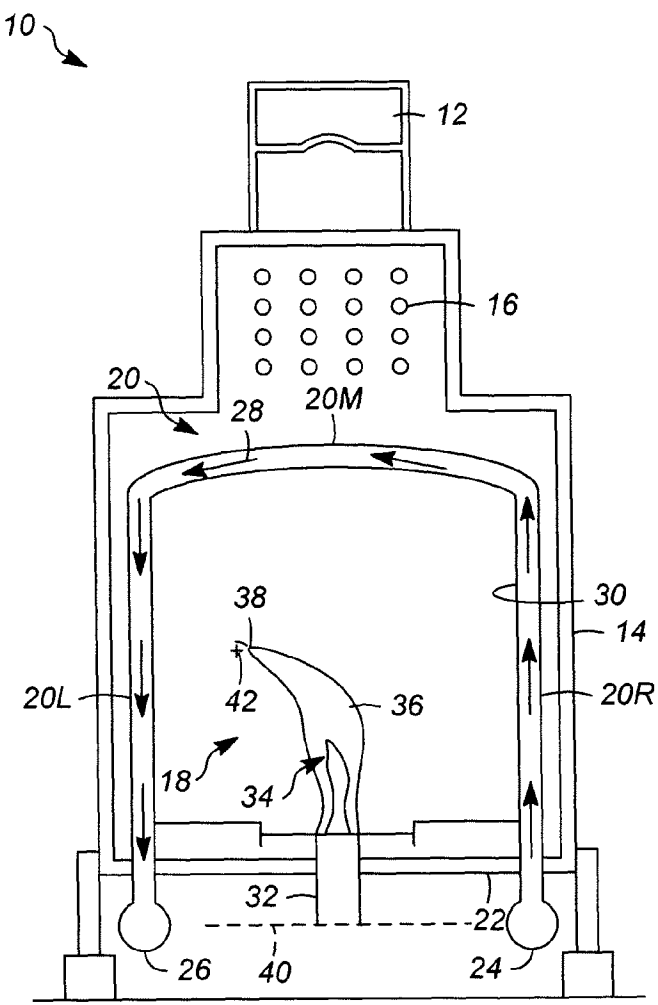

FIGS. 1A-7B show various versions of heaters 18, 118, 218, 318, 418, 518, 618. Any version of a heater may be included in a furnace 10; one example of which is shown in FIGS. 1A and 1B. A furnace 10 generally comprises a stack 12, refractory walls 14, a base 22, convection coils 16, and at least one heater 18, for example, within the walls 14. The furnace 10 may also comprise a damper (not shown) and air blower (not shown) which provides air to the burners, which is described below.

In each version, the heaters 18, 118, 218, 318, 418, 518, 618 comprise at least one channel and at least one adjustable burner. Materials of a process stream flow through the at least one channel. The process stream may include solids, liquids, gases or mixtures thereof. In particular, the process stream may include hydrogen, light hydrocarbons, LPG, gasoline, naphtha, kerosene, distillate oil, or other liquids, gases or solids.

The adjustable burner (or burners) combusts fuel with an oxidizer to produce a flame having a body and a tip, as is known in the art. The burner may be virtually any burner including a low $NO_x$ burner, for example. The flame may have a substantially round cross-section or may have another shape such as a substantially square or rectangular cross-section. Where the heater is used in an industrial process such as in oil refineries and petrochemical plants and where the burner is located in a bottom-fired heater, the flame may extend up to about one-third to about one-half of the height of the firebox. This heater design usually translates to the flame extending upward about 50 feet from the base.

As shown in the figures, the adjustable burners may be placed in many different locations within the heater or furnace. In particular, the burners may be placed along a base or along a refractory wall. Each of these burner locations may be referred to generally, as a mounting surface. In addition, the adjustable burners may be used with many different types of heaters.

Further, in each version, the burners are adjustable and, therefore, comprise means for quickly and easily adjusting their position when online or in use. Such means may be manual or automated and are described in more detail below. As provided below, the adjustable burners may be adjusted to account for conditions inside or outside the furnace such as internal flue gas box currents and environmental conditions such as wind, and the like.

FIGS. 1A-1D show one version of a heater 18. The heater 18 comprises at least one channel 20 and at least one adjustable burner 32. The adjustable burner 32 is positioned on the floor or base 22 of the heater 18 and fires substantially, vertically-upward. Such a configuration is often referred to as a bottom-firing orientation. The channel 20 is shown as an arbor coil. Such a furnace 10, collectively, is often referred to as a wicket-fired heater. As provided above, the adjustable burner 32 may be used with other types of heaters or furnaces having different channels and burner orientations. For example, the disclosed burner 32 may be used in U-tube, I-coil, W-coil, Y-coil, vertical cylindrical, vertical cylindrical with cross-tube convection, serpentine, other coiled-style furnaces or the like. The adjustable burner 32 may be oriented in bottom fired, top fired, horizontal fired or angled fired positions or the like.

As shown in FIGS. 1A and 1B the channel 20 has a left-side vertical portion 20L or member and a right-side vertical portion 20R or member that are connected by a middle or arbor portion 20M or member. The left-side vertical portion 20L and the right-side vertical portion 20R extend vertically from a base 22, which may be a refractory or masonry base.

The left-side vertical portion 20L and the right-side vertical portion 20R are coupled to and are in communication with at least one terminal manifold. Preferably, the left-side vertical portion 20L is coupled to the outlet terminal manifold 26 and the right-side vertical portion 20R is coupled to the inlet terminal manifold 24. A process stream 28 flows from the inlet terminal manifold 24 upward, through the right side portion 20R, through inverted U-shaped, middle portion 20M and then through the left-side vertical portion 20L and out the outlet terminal manifold 26. Such a process stream 28 may comprise hydrogen and/or hydrocarbons, inert gas or other process fluid. It will be understood that the left-side vertical portion 20L may be coupled to the inlet terminal manifold and the right-side vertical portion 20R may be coupled to the outlet terminal manifold if desired and the direction of flow of process stream may be reversed.

The surface of the channel 20 provides a radiant heating surface 30. Radiant heat from the burner 32 and flame 34 is provided to the radiant heating surfaces 30, which transfers heat to the process materials 28 within the channel 20. The channel 20 may have virtually cross-section such as circular, square, rectangular, oval or the like. Preferably, the channel 20 has a circular cross-section with a uniform diameter and is tubular; i.e., is not an open channel 20. Where the heater 18 is used in an industrial process such as in oil refineries and petrochemical plants, the left-side vertical portion 20L and the right-side vertical portion 20R may extend up to about 60 feet. Preferably, the left-side vertical portion 20L and the right-side vertical portion 20R extend up to about 40 feet.

FIGS. 1A and 1B also show at least one adjustable burner 32, which is capable of producing a flame 34 having a body 36 and a tip 38. The burner 32 may be virtually any burner including a low $NO_x$ burner, for example. The adjustable burner 32 is coupled to the base 22. Thus, in the version shown in FIGS. 1A and 1B, it is bottom fired. The adjustable burner 32 is positioned substantially central between the left-side vertical portion 20L and the right-side vertical portion 20R. In other words, the burner 32 is disposed substantially equidistant from each vertical member. It will be understood that the burner 32 may be side fired or positioned at the ceiling (i.e., it may be oriented in top fired, horizontal fired or angled fired positions and the like). In addition, whether positioned at the base 22 or ceiling, the burner 32 may be positioned closer to the left-side vertical portion 20L or right-side vertical portion 20R rather than centrally.

Figure 1C:
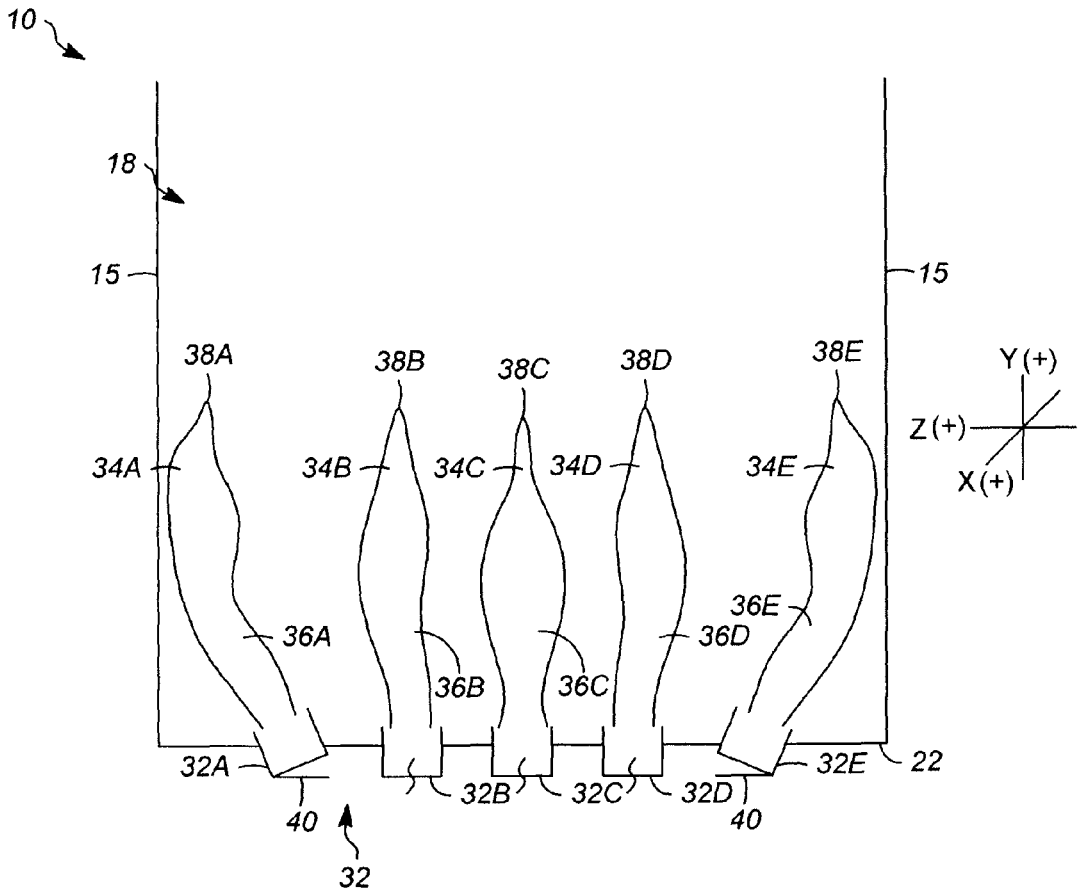
FIG. 1C is a side view of the version of the heater shown in FIGS. 1A and 1B, having a plurality of adjustable burners with two burners in the adjusted position and arbor-type channels removed for clarity.
Figure 1D:
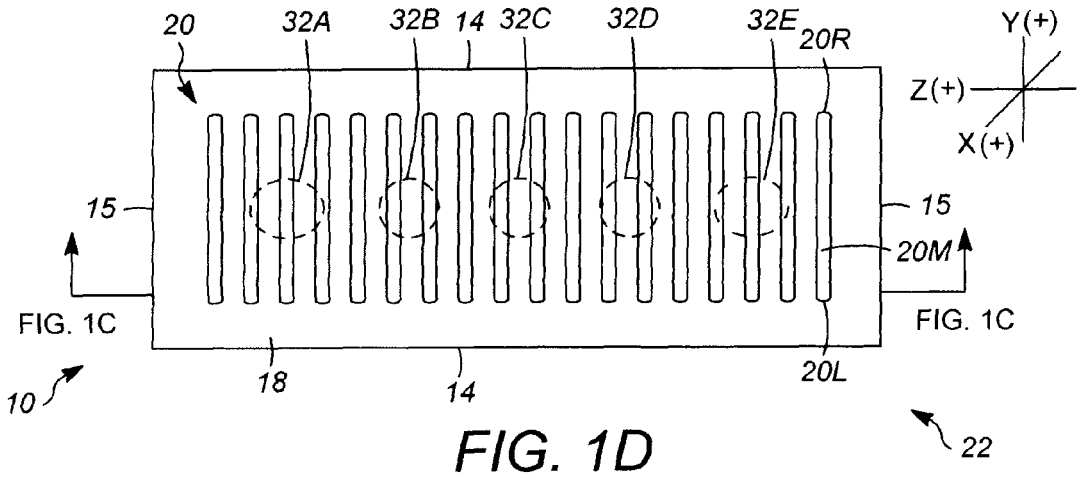
FIG. 1D is a top plan view of the heater shown in FIG. 1C but with all adjustable burners in the neutral position.

As shown, the adjustable burner 32 may be positioned slightly above the inlet terminal manifold 24 and the outlet terminal manifold 26, however, it may be positioned even with or below. The burner 32 may be positioned substantially within the plane of the channel 20 (i.e., it is not positioned forward or rearward with respect to the "Z" axis.) The burner 32 may be positioned forward or rearward of the plane of the channel 20 (i.e., along the "Z" axis), which is shown in FIG. 1D. Where the heater 18 is used in an industrial process such as in oil refineries and petrochemical plants, the flame 34 may extend up to about 50 feet.

FIG. 1A shows the burner 32 in a first or neutral position. In this position, the burner 32 is substantially horizontal with respect to a substantially horizontal imaginary ground plane 40. The body 36 of the flame 34 is disposed substantially central with respect to the left-side vertical portion 20*a* and right-side vertical portion 20*b*. In other words, the body 36 of the flame 34 is disposed substantially equidistant from these vertical portions. However, the tip 38 of the flame 34 may not be positioned centrally, but may be positioned more toward either the left-side vertical portion 20L or the right-side vertical portion 20R. In other words, tip 38 of the flame 34 may be disposed off-center with respect to the burner 32 or the body 36 of the flame 34. This off-center position of the flame may be due to environmental conditions such as wind, or a draft or the like, from flue gas from the stack 12 or from box currents within the firebox.

The tip 38, therefore, may produce a relatively intense heat spot 42 adjacent the left-side vertical portion 20L. In particular, as shown in FIG. 1A, the tip 38 of the flame 34 is positioned more closely toward the left-side vertical portion 20L. This tip position may cause unbalanced heating of a process stream 28 within the channel 20, or it may damage the channel 20. FIG. 1B shows the burner 32 in an adjusted position to offset the box currents or environmental conditions within the heater that cause the flame tip 38 to be positioned undesirably close to the channel 20. Preferably, the burner 32 is locked in this position via locking means discussed below. In this position, the burner 32 is angled at an angle $A_1$ with respect to the imaginary horizontal ground plane 40. $A_1$ may be about 1 degree to about +30 or −30 degrees. Preferably, $A_1$ is about 7 to about 15 degrees. In addition, even though $A_1$ is shown to be positive as defined by the axis shown, $A_1$ may be negative. For example, the adjustable burner 32 may be tilted in the other direction such that the flame is closer to left side portion 20L. In this regard, $A_1$ may be about −1 degree to about −30 degrees.

In the second position, the body 36 of the flame 34 is no longer positioned substantially central with respect to the left-side vertical portion 20L and the right-side vertical portion 20R. Rather, it is positioned more closely to the right-side vertical portion 20R. However, the tip 38 of the flame 34 is now positioned substantially central with respect to the left-side vertical portion 20L and the right-side vertical portion 20R. In other words, tip 38 of the flame 34 is disposed substantially equidistant from the vertical portions but is off-center with respect to the burner 32 and body 36 of the flame 34. Thus, the tip 38 produces intense heat spot 42 substantially equidistant from the vertical portions rather than close to the right-side vertical portion 20R or left-side vertical portion 20L. Because the tip 38 of the flame 34 is more centered, this position makes for more balanced heating and provides less chance for the channel 20 to be damaged. However, because the body 36 of the flame 34 is positioned closer to the right-side vertical portion 20R, this portion may receive more radiant heat. Thus, the burner 32 may be adjusted to compensate for environmental conditions that may reposition the flame 34 and tip 38 of the flame 34. The burner 32 can also counter tube flame impingement, burner tip plugging, thermal currents in the firebox, and may be used for flue gas hydraulic leveling.

In addition, even though FIG. 1B shows the burner 32 tilted within the plane of the channel 20, the burner 32 may be tilted forward or rearward with respect to the plane of the channel 20 (i.e., it may be tilted along the "Z" axis). Further, the adjustable burner 32 may be rotated clockwise or counter-clockwise three-hundred-and-sixty degrees (360°) and be tilted along this axis of rotation. Even though FIGS. 1A and 1B show only one burner and one channel, multiple burners and channels may be included in the heater, as shown in FIGS. 1C and 1D. The adjustable burner 32 optimizes the flame location for multiple burners.

FIGS. 1C and 1D show essentially the heater 18 of FIGS. 1A and 1B but with multiple adjustable burners 32A-32E positioned below multiple channels 20 (FIG. 1D). The adjustable burners 32A-32E fire upward (see FIG. 1C) and the channels 20 extend upward and over the burners (i.e., in the "Y" direction). The heater 18 shown in FIGS. 1C and 1D has five adjustable burners 32A-32E extending along the "Z" direction length of the heater 18. (FIG. 1D). Each adjustable burner 32A-32E is positioned beneath eighteen (18) arbor coil channels, generally designated as 20. More or less adjustable burners or channels may be used in the heater 18. Preferably, the heater 18 has about twenty (20) to about one-hundred (100) channels, each carrying a process stream.

As shown in FIG. 1C, the five adjustable burners 32A-32E are positioned on the floor or base 22, next to each other. (In FIG. 1C, the channels have been removed for clarity.) In other words, the burners 32A-32E are positioned in substantially the same plane in the "X" direction. The burners 32A-32E, however, may be positioned "off-line" or staggered with respect to one-another.

As shown in FIG. 1C, the adjustable burners 32A, 32E closest to the refractory walls 15 may be tilted toward the walls 15 while the three adjustable burners 32B, 32C, 32*d* remain in the neutral position. (Walls 15 are removed for clarity in FIGS. 1A and 1B.) Burner 32A may be tilted about −1 degree to about −30 degrees along the "Z" direction and burner 32E may be tilted about 1 degree to about 30 degrees along the "Z" direction. Preferably, burner 32A is tilted about −7 to about −15 degrees and burner 32E is tilted about 7 to about 15 degrees. Burners 32B-32D are shown in the neutral position but may be tilted in any direction.

Tilting burners 32A and 32E toward the walls 15 positions flames 34A, 34E closer to the walls 15, which provides more heat to the walls 15. More heat to the walls 15 provides more radiation to the heater 18, which promotes uniform heating of the channels 20. The box currents within the fire box or heater 18 that cause flames 34A-34E to move undesirably close to the channels 20, as shown in FIG. 1B for example, may be due, in part, to a temperature difference between the colder walls 14, 15 and the flames 34A-34E from the burners 32A-32E. Thus, more heat provided to the walls 15 makes them warmer, which helps break-up or disrupt or reduce the thermal box currents. Adjustable burners 32B-32*d* produce flames 34B-34D that extend substantially parallel to walls 14.

Figure 2A:
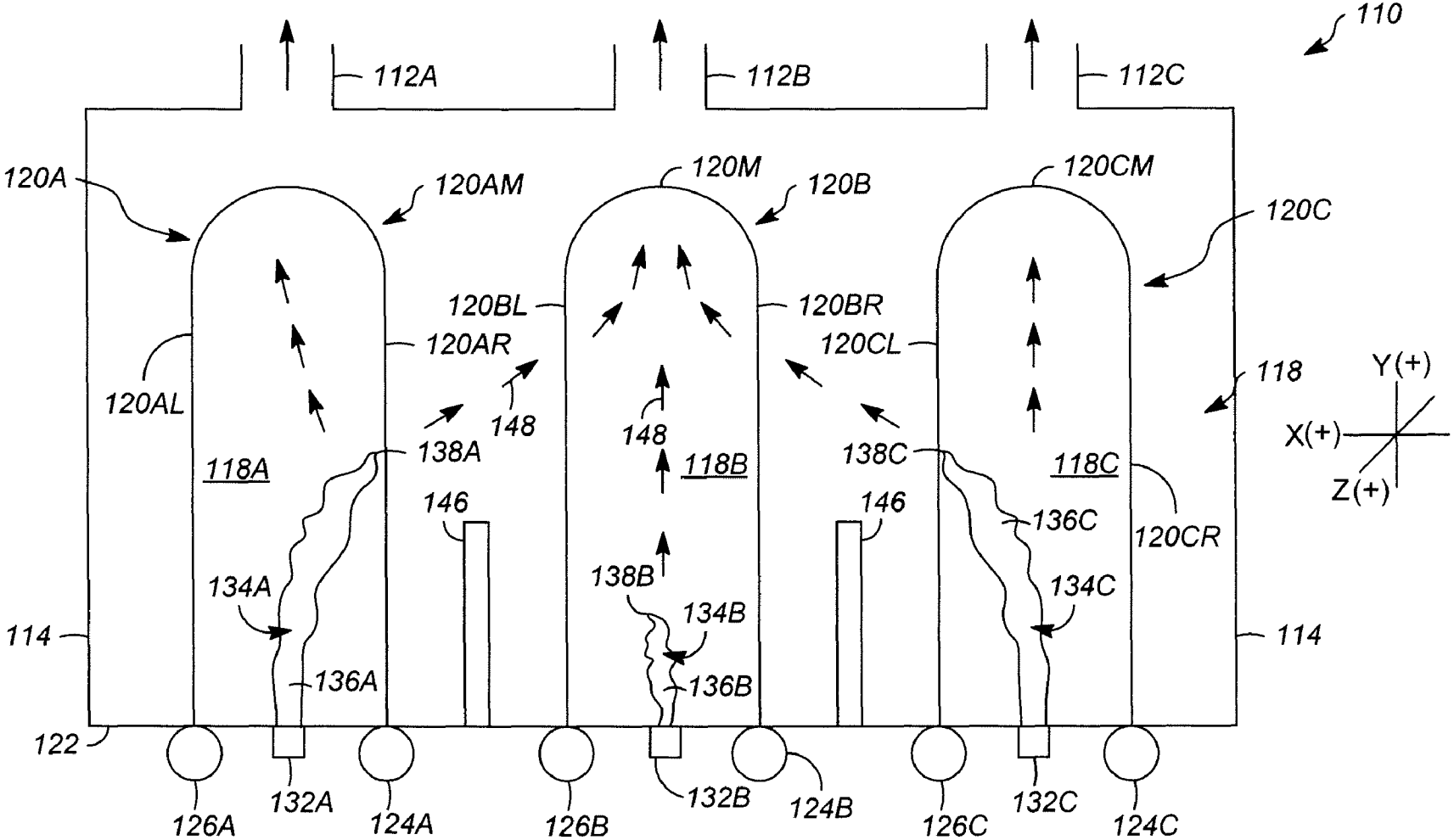
FIG. 2A is a front view of another version of a heater having at least three adjustable burners and at least three arbor-type channels, with the adjustable burners in the neutral position.
Figure 2B:
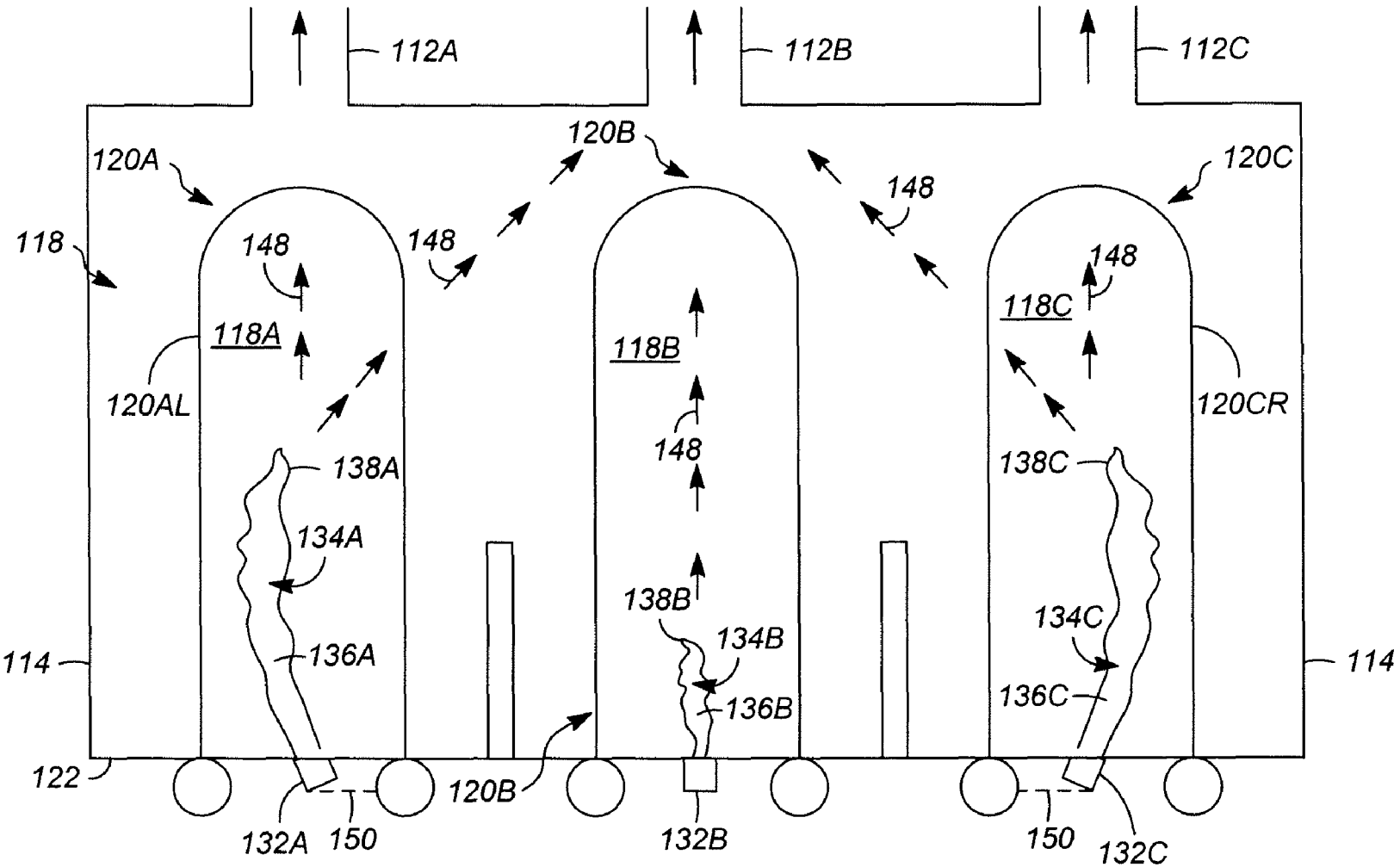
FIG. 2B is a front view of the heater shown in FIG. 2A with the second adjustable burner in the neutral position and the first and third adjustable burners in an adjusted position.

FIGS. 2A and 2B show another version of a fired heater 118. This version is essentially three of the heaters shown in FIGS. 1A and 1B, aligned side-by-side in the X-direction. A second wicket-fired heater 118B is separated from a first wicket-fired heater 118A and third wicket-fired heater 118C by walls 146. Unlike FIGS. 1A and 1B, the heater 118 of FIGS. 2A and 2B has three outlet ducts 112A, 112B and 112C, one corresponding to each heater 118A-118C. A convection section (not shown) may be provided above and in communication with each duct 112A, 112B and 112C. In addition, unlike the heater of FIGS. 1A and 1B, the adjustable middle burner 132A is "low-firing." In other words, adjustable burner 132B is set to produce a flame 134B that does not extend as high as flames 134A and 134C. Low firing flame 134B may extend up to about one-third of the height of flames 134A and 134C.

First wicket-fired heater 118A comprises an adjustable burner 132A and a channel 120A. Second wicket-fired heater 118B comprises adjustable burner 132B and channel 120B. Third wicket-fired heater 118C comprises adjustable burner 132C and channel 120C. Each channel 120A, 120B and 120C is preferably an arbor-type channel as described above with respect to the other versions.

Each adjustable burner 132A, 132B, 132C is coupled to a base 122; i.e., the burners are bottom fired. Each burner 132A, 132B, 132C may be positioned substantially central between its respective left-side vertical portion 120AL, 120BL, 120CL and right-side vertical portion 120AR, 120BR, 120CR of each channel 120A, 120B, 120C. In other words, the burners 132A, 132B, 132C are disposed substantially equidistant from each vertical member. However, the burners 132A, 132B, 132C may be positioned closer to the left-side vertical portion or right-side vertical portion rather than centrally.

The adjustable burners 132A, 132B, 132C may be positioned slightly above each inlet terminal manifold 124A, 124B, 124C and outlet terminal manifold 126A, 126B, 126C, however, the burners may be positioned even with or below these manifolds. In addition, the burners 132A, 132B, 132C may be positioned substantially within the plane of the channels 120A, 120B, 120C (i.e., with respect to the z-axis) but in other versions, may be staggered along this direction.

Often times, heaters 118A, 118B, 118C, such as those shown in FIGS. 2A and 2B are subject to box currents. FIG. 2A shows adjustable burners 132A, 132B and 132C in the first or neutral position. When burners 132A and 132C are in the first position, their respective flames 134A, 134C "lean" due to the box currents. As such, flame tip 138A is positioned close to or on right-side portion 120AR. Flame tip 138C is positioned close to or on left-side portion 120CL of channels 120A and 120C, respectively. As provided above with respect to FIGS. 1A and 1B, this produces intense heat spots (not shown) near these portions, which may impinge these portions of the channels 120A, 120C. Further, hot internal flue gas currents 148 may carry heat from flames 134A and 134C such that this heat contacts, and may further impinge, the channel 120B, especially at portions 120BL and 120BR. This heat may overheat and thereby damage channel 120B.

FIG. 2B shows adjustable burners 132A and 132C tilted or adjusted to offset their lean from the box currents. In particular, adjustable burner 132A may be titled from about −1 degree to about −30 degrees in the x-direction. Burner 132C may be tilted from about 1 degree to about 30 degrees in the x-direction. Preferably, burner 132A is tilted from about −7 degrees to about −15 degrees with respect to the horizontal plane and burner 132C is tilted about 7 degrees to about 15 degrees with respect to the horizontal plane 150.

In the adjusted position, the flames 134A and 134C of burners 132A and 132C, respectively, are positioned closer to refractory walls 114. The box currents 148 within the fire box or heater 118 that cause the flames 134A, 134C to move undesirably close to the channels, are due, in part, to the temperature difference between the colder wall and the flames 134A-134C from the burners 132A-132C. More heat provided to the walls 114 makes them warmer, which helps break-up or disrupt or reduce the harmful box currents 148. With respect to the positions shown in FIG. 2B, flame 134A is positioned closer to left-side portion 120AL and flame 134C is positioned closer to right-side portion 120CR. The tips 138A, 138C of flames 134A and 134C, respectively are now positioned substantially central with respect to the left-side and right-side vertical portions of channels 120A and 120C, respectively. As provided with regard to FIGS. 1A and 1B, tips 138A, 138C of flames 134A, 134C, respectively are now disposed substantially equidistant from the vertical portions of channels 120A, 120C, respectively but are off-center with respect to the burner 132A, 132C and bodies 136A, 136C of flames 134A, 134C. Thus, tips 138A, 138C produce intense heat spots (not shown) substantially equidistant from the vertical portions of the channels 120A, 120C rather than closer to one vertically-extending side of the channels 120A, 120C. This burner adjustment makes for more balanced heating and provides less chance for the channels 120A, 120C to be damaged from excessive heat. Because the bodies 136A, 136C of flames 134A, 134C are positioned closer to a vertically-extending portion of the channels 120A, 120C, these portions (120AL, 120CR) will receive more radiant heat than the remainder of the channels 120A, 120C.

Further, because of the angle of flames 134A, 134C, the internal flue gas currents 148 carry the heat from burners 132A, 132C over the channel 120B and out of flue gas outlet duct 112B. Low firing flame 134B, due to its shorter flame, also allows these hot currents to move over channel 120B and out through duct 112B. This flame adjustment promotes an equal flow rate out of each duct 112A, 112B, 112C. Thus, channel 120B of the second wicket-fired heater 118B does not receive excessive heat as it may when the heaters are in the first position, shown in FIG. 2A. As shown in FIG. 2B, some of the heat from flames 134A and 134C is carried out of flue gas outlet ducts 112A and 112C, respectively, by currents 148.

Figure 3A:
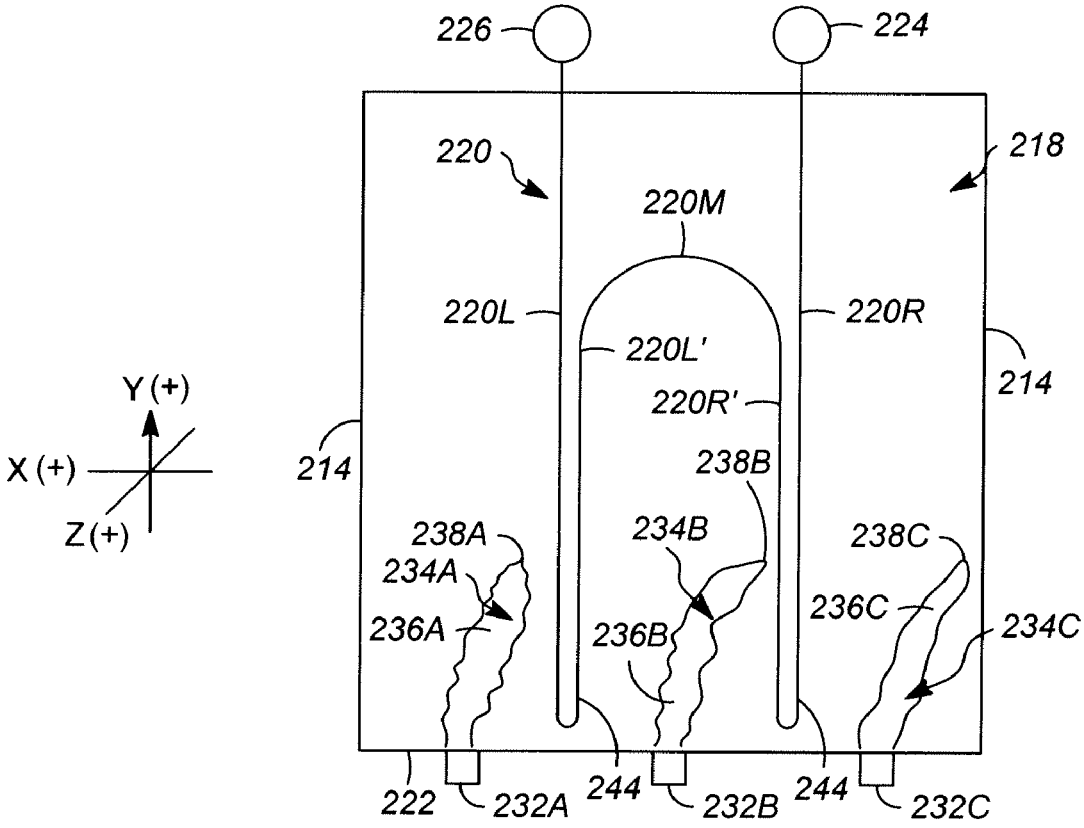
FIG. 3A is a front view of another version of a heater having three adjustable burners and at least one W-coil-type channel, with the adjustable burners in the neutral position.
Figure 3B:
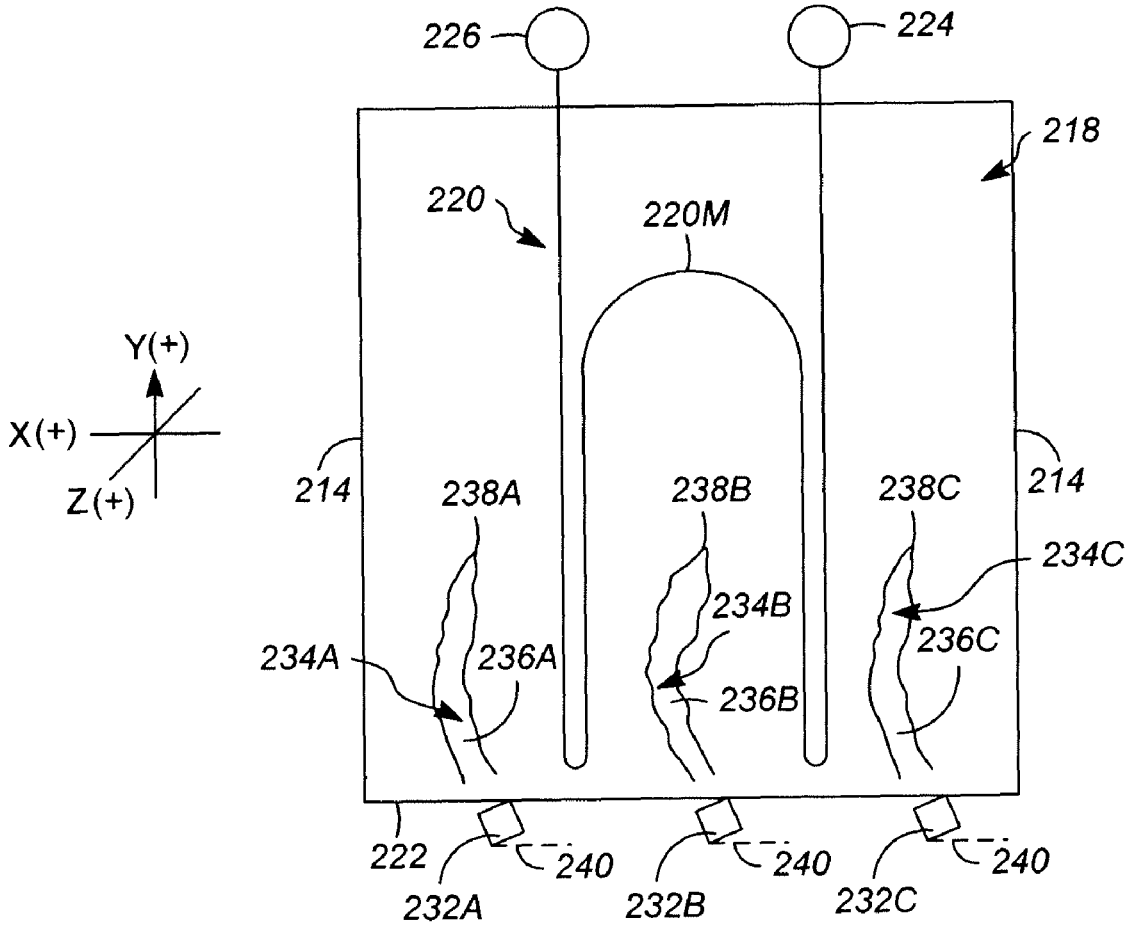
FIG. 3B is a front view of the heater shown in FIG. 3A with the adjustable burners in an adjusted position.

FIGS. 3A-3B show another version of a heater 218. The adjustable burners 232A-232C shown in this version are identical to those shown in FIGS. 2A and 2B. The difference between the heater 118 of FIGS. 2A and 2B and the heater 218 of this version, is that there is only one channel 220, and it is located at middle burner 232B. In addition, the channel 220 in the version shown in FIGS. 3A-3B is a "W-coil" type channel instead of an arbor-type channel, which are shown in FIGS. 2A-2B. The channel 220 is similar to that shown in FIGS. 1A and 1B in that it comprises a left-side portion and a right-side portion connected by a middle portion, which is concave with respect to the base 222. As shown in FIGS. 3A and 3B, the left-side portion 220L is in communication with outlet manifold 226 and right-side portion 220R is in communication with inlet manifold 224.

Unlike the channels shown in FIGS. 1A-2B, channel 220 has inlet manifold 224 and outlet manifold 226 positioned above the arbor portion 220M. In addition, as shown in FIG. 3A, the channel 220 comprises an outer left-side portion 220L and an inner left-side portion 220L'. Similarly, channel 220 comprises an outer right-side portion 220R and an inner right-side portion 220R'. These portions are connected by a return bend 224L, 224R. The outer left-side vertical portion 220L and the outer right-side vertical portion 220R may extend up to about 60 feet. Preferably, the outer left-side vertical portion 220L and the outer right-side vertical portion 220R extend up to about 40 feet.

Process stream (not shown) flows through the inlet manifold 224, down through outer right-side portion 220R, around return bend 244R to inner right-side portion 220R' over middle portion 220M, through inner left-side portion 220L', around bend 244L, through outer left-side portion 220L and out outlet manifold 226. Process stream is heated by heat from adjustable burners (as provided above) and which are described below.

FIGS. 3A and 3B, show three adjustable burners; a first adjustable burner 232A, a second adjustable burner 232B and a third adjustable burner 232C. Adjustable burners 232A, 232B, 232C are positioned on the floor or base 222 of the heater and produce flames 234A, 234B, 234C that extend upward in the vertical direction (i.e., they are bottom-firing). As in the versions above, adjustable burners 232A, 232B, 232C may be situated in a refractory or masonry base. Preferably, adjustable burners 232A, 232B, 232C are positioned substantially within the plane of the channel 220 with respect to the Z-direction. However, the burners 232A, 232B, 232C may be positioned forward or rearward or staggered.

First adjustable burner 232A and third adjustable burner 232C are positioned on opposing sides of the channel 220. Preferably, first adjustable burner 232A is positioned substantially central with respect to the outer left-side vertical portion 220L of channel 220 and wall 214. Preferably, third adjustable burner 232C is positioned substantially central with respect to the outer right-side vertical portion 220R of channel 220 and wall 214. The second adjustable burner is positioned within the channel 220. Preferably, second adjustable burner 232B is positioned substantially central between the inner left-side vertical portion 220L' and the inner right-side vertical portion 220R'.

Heaters, such as those shown in FIGS. 3A and 3B are often subject to thermal gradients that cause flames to "lean" more to one side than the other. FIG. 3A shows burners 232A, 232B, 232C in a first position or substantially horizontal with respect to a substantially horizontal imaginary ground plane 240 (FIG. 3B). Due to the thermal gradients, flames 234A, 234B and 234C may "lean" to the right. As such, flame 234A is closer to outer left-side vertical portion 220L, flame 234B is closer to inner right-side vertical portion 220R' and flame 234C is closer to wall 214. Flame 234A may overheat outer left-side portion 220L of the channel 220. Similarly, flame 234B may overheat inner right-side portion 220R' of channel 220.

FIG. 3B shows burners 232A, 232B, 232C tilted with respect to horizontal ground plane 240 to compensate for the flame "lean" caused by the internal thermal gradients (not shown). Preferably, burners 232A, 232B, 232C are locked in this position via a locking means, discussed below. In particular, adjustable burners 232A, 232B and 232C may be titled from about −1 degree to about +30 degrees in the x-direction, with respect to horizontal ground plane 240. Burners 232A, 232B, 232C may be tilted from about −7 degrees to about −15 degrees with respect to the horizontal plane. In this tilted or adjusted position, body 236B of middle flame 234B is disposed closer to inner left-side portion 220L'. However, tip 238B of middle flame 234B is now disposed substantially central with respect to inner portions 220L' and 220R'. Thus, tip 238B produces intense heat spot (not shown) substantially equidistant from the vertical portions rather than close to either the left or right-side vertical portions of the channel 220. Because the tip 238B of the flame 234B is more centered, this position makes for more balanced heating and provides less chance for the channel 220 to be damaged. Because the body 236B of the flame 234B is positioned closer to the inner left-side vertical portion 220L', this portion will receive more radiant heat.

Similarly, body 236A of first flame 234A is disposed closer to refractory wall 214 but tip 238A is disposed substantially central with respect to refractory wall 214 and the outer left-side vertical portion 220L of channel 220. Thus, intense heat spot (not shown) is substantially equidistant from the refractory wall 214 and portion 220L, where there is less of a chance for intense heat to impinge that portion of the channel 220. Because the body 236A of flame 234A is closer to refractory wall 214, it heats refractory wall 214, which in turn, provides radiant heat to the heater 218.

Similarly, body 236C of third flame 234C is disposed closer to outer right-side portion 220R of the channel 220. However, tip 238C and body 234C are disposed substantially central with respect to refractory wall 214 and outer right-side portion 220R of the channel 220. Thus, intense heat spot (not shown) is substantially equidistant from the refractory wall 214 and outer right-side portion 220R of the channel 220. As such, there is less of a chance for excessive heat from flame 234C to impinge this portion of the channel 220.

Figure 4B:
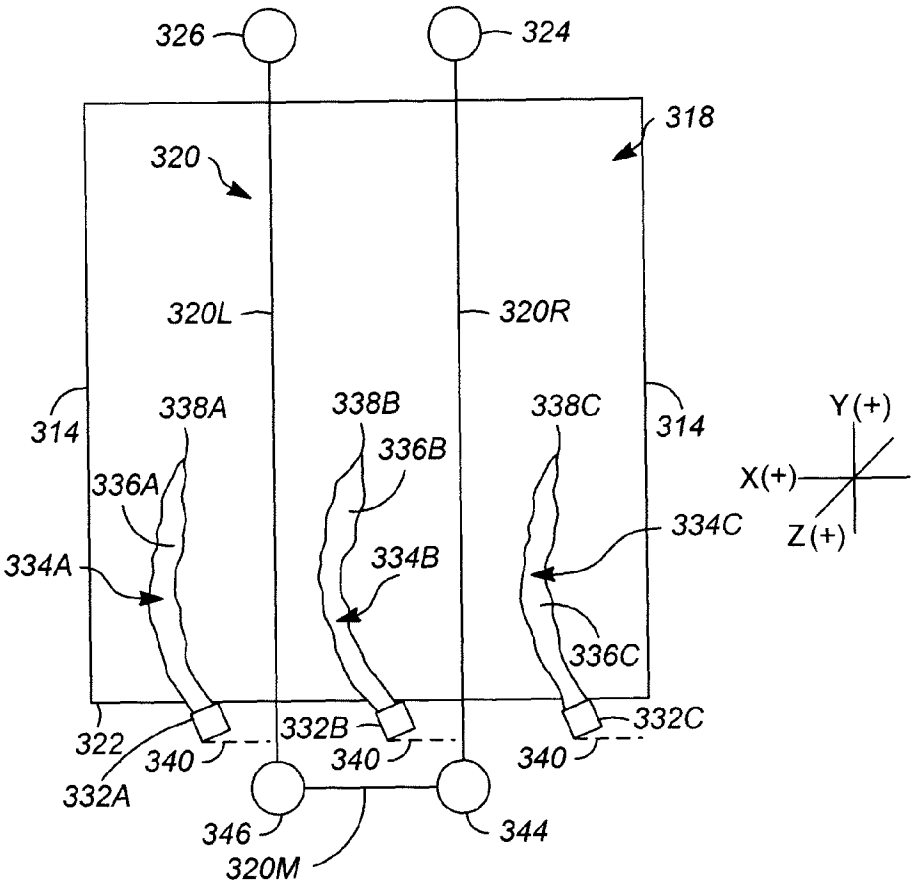
FIG. 4B is a front view of the heater shown in FIG. 4A with the adjustable burners in an adjusted position.
Figure 4A:
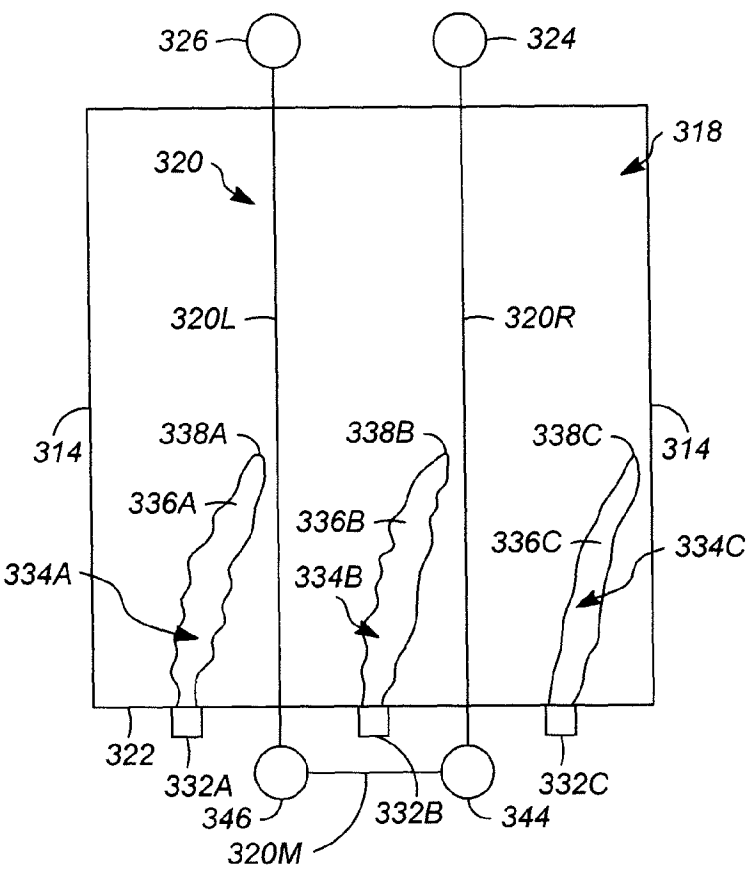
FIG. 4A is a front view of another version of a heater having three adjustable burners and at least one Double-I-coil-type channel, with the adjustable burners in the neutral position.

FIGS. 4A and 4B show another version of a heater 318. This version is similar to that shown in FIGS. 3A and 3B except that this version uses a "Double-I" coil-type channel. The channel 320 comprises a left-side vertical portion 320L and a right-side vertical portion 320R. However, unlike the previously-described channels, left-side vertical portion 320L and right-side vertical portion 320R are connected by middle portion (cross-over manifold) 320M extending substantially horizontally between left-side vertical portion 320L and right-side vertical portion 320R, below floor 322.

The left-side vertical portion 320L extends vertically between, and connects with, an external outlet manifold 346 and the internal outlet manifold 326. The right-side vertical portion 320R extends vertically between, and connects with, an external inlet manifold 344 and an internal inlet manifold 324. The left-side vertical portion 320L and the right-side vertical portion 320R may extend up to about 80 feet. Preferably, the left-side vertical portion 320L and the right-side vertical portion 320R extend up to about 50 feet. External inlet manifold 344 is connected to external outlet manifold 346 via middle portion (cross-over manifold) 320M. A process stream (not shown) flows through inlet manifold 324, down through right-side portion 320R, out through intermediate exit manifold 344, into cell through manifold 346 up through left-side portion 320L and out through outlet manifold 326. The surface of the channel 320 provides a radiant heating surface, as described above.

Similar to the version shown in FIGS. 3A and 3B, three the adjustable burners 332A, 332B, and 332C are positioned on the floor or base 322 of the heater 318 and produce flames 334A, 334B, 334C that extend upward in the vertical direction (i.e., they are bottom-firing). As in the versions above, adjustable burners 332A, 332B, and 332C may be situated in a refractory or masonry base 322.

First adjustable burner 332A and third adjustable burner 332C are positioned on opposing sides of the channel 320. Preferably, first adjustable burner 332A is positioned substantially central between wall 314 and left-side portion 320L of the channel 320. Preferably, third adjustable burner 332C is positioned substantially central between wall 314 and right-side vertical portion 320R. The second adjustable burner 332B is positioned substantially central between the left-side vertical portion 320L and the right-side vertical portion 320R. The three burners 332A, 332B, and 332C are positioned substantially within the plane of the channel 320 with respect to the Z-direction. However, burners 332A, 332B, and 332C may be positioned forward or rearward of the plane of the channel 320 and may be staggered.

A heater 318, such as that shown in FIGS. 4A and 4B, is often subject to thermal gradients that cause flames to "lean" more to one side than the other. FIG. 4A shows burners 332A, 332B, 332C in a first or neutral position, substantially horizontal with respect to a substantially horizontal imaginary ground plane 340. Due to the thermal gradients, flames 334A, 334B and 334C may "lean" more to the right. As such, flame 334A is closer to left-side vertical portion 320L, flame 334B is closer to right-side vertical portion 320R and flame 334C is closer to wall 314. Thus, flame 334A may overheat left-side portion 320L of the channel 320. Similarly, flame 334B may overheat right-side portion 320R of channel 230.

FIG. 4B shows burners 332A, 332B, 332C tilted with respect to horizontal ground plane 340 to compensate for the flame "lean" caused by the internal thermal gradients (not shown). Preferably, burners 332A, 332B, 332C are locked in this position via a locking means.

Adjustable burners 332A, 332B and 332C may be tilted from about −1 degree to about +30 degrees in the x-direction, with respect to horizontal ground plane 340. Burners 332A, 332B, 332C may be tilted from about −7 degrees to about −15 degrees with respect to the horizontal plane. Body 336B of middle flame 334B is disposed closer to left-side portion 320L. Tip 338B of middle flame 334B is now disposed substantially central with respect to the left-side portion 320L and right-side portion 320R. Thus, tip 338B produces an intense heat spot (not shown) substantially equidistant from the vertical portions rather than close to either the left or right-side vertical portions 320L, 320R of the channel 320. Because the tip 338B of the flame 334B is more centered, this position makes for more balanced heating and provides less chance for the channel 320 to be damaged. Because the body 336B of the flame 334B is positioned closer to the left-side vertical portion 320', this portion will receive more radiant heat.

Similarly, body 336A of first flame 334A is disposed closer to refractory wall 314 but tip 338A is disposed substantially central with respect to refractory wall 314 and the left-side vertical portion 320L of channel. Thus, the intense heat spot (not shown) is substantially equidistant from the refractory wall and left-side portion 320L, where there is less of a chance for it to impinge a portion of the channel 320. Because the body 336A of flame 334A is closer to refractory wall 314, it heats refractory wall 314, which in turn, provides radiant heat to the heater 318.

Similarly, body 336C of third flame 334C is disposed closer to right-side portion 320R of the channel 320. However, tip 338C is disposed substantially central with respect to refractory wall 314 and right-side portion 320R of the channel 320. Thus, the intense heat spot (not shown) is substantially equidistant from the refractory wall 314 and outer right-side portion 320R of the channel 320. As such, there is less of a chance for excessive heat from flame 334C to impinge a portion of the channel 320.

Figure 5A:
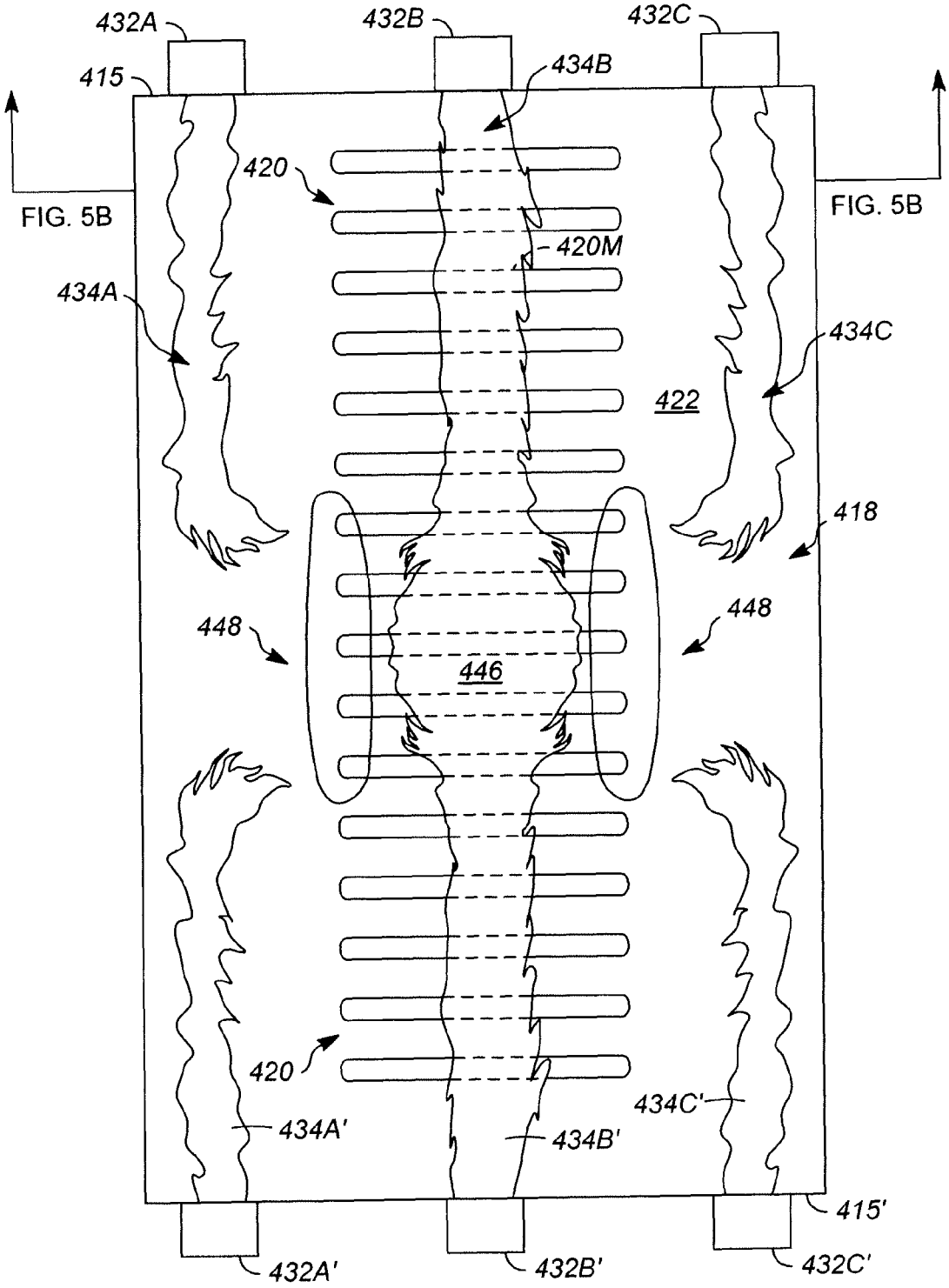
FIG. 5A is a top plan view of another version of a heater having a plurality of end-wall-mounted adjustable burners and a plurality of U-coil-type channels, with the adjustable burners in the neutral position.
Figure 5C:
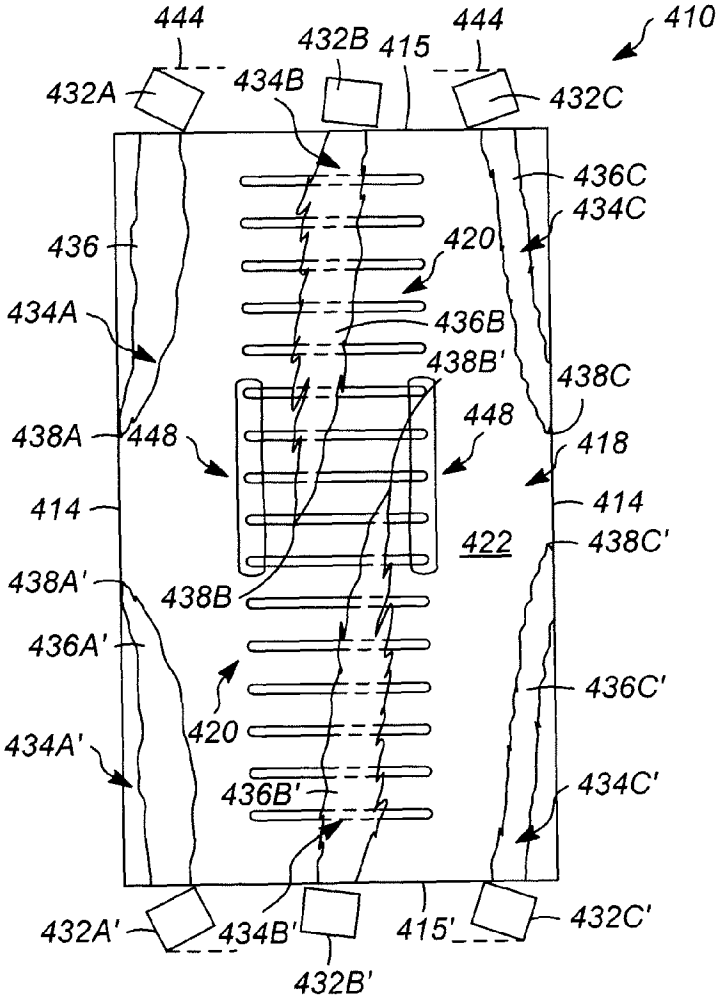
FIG. 5C is a top plan view of the heater shown in FIG. 5A with the adjustable burners in an adjusted position.
Figure 5B:
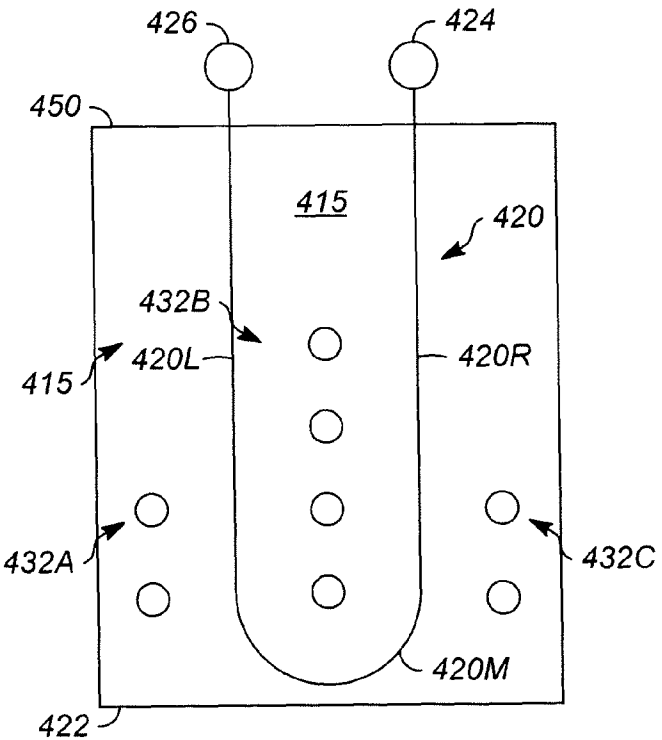
FIG. 5B is a front view of one end wall and U-coil-type channel of the heater shown in FIG. 5A.

FIGS. 5A-5C show another version of a heater 418. As shown in FIG. 5A, this version comprises a plurality of channels 420 and a plurality of adjustable burners 432A, 432A', 432B, 432B', 432C, 432C'. Groups of adjustable burners on wall 415 are generally designated as 332A-332C. Groups of burners on opposing wall 415' are generally designated as 332A'-332C'. Unlike the versions shown in FIGS. 1A-4B, in this version, the adjustable burners 332A-332C, 332A'-332C' are disposed along end walls 415, 415' rather than being disposed along the floor or base 422. In particular, as shown in FIG. 5A, the adjustable burners 332A-332C are disposed at end wall 415 and adjustable burners 332A'-332C' are disposed on end wall 415'. Each set of opposing burners provide flames extending substantially horizontal to the floor or base 422.

FIG. 5B shows one of the end walls 415 and one of the plurality of channels 420. The channel 420 has a left-side vertical portion 420L or member and a right-side vertical portion 420R or member that are connected by a central or middle portion 420M. The left-side vertical portion 420L and the right-side vertical portion 420R extend downwardly from the ceiling 450. The left-side vertical portion 420L is coupled to and in communication with the outlet terminal manifold 426. The right-side vertical portion 420R is coupled to and in communication with the inlet terminal manifold 424. Such a channel may be referred to as a U-shaped coil.

Process stream (not shown) may flow from the inlet terminal manifold 424 through right-side portion 420R, through middle portion 420M, through left-side portion 420L, to outlet manifold 426. However, the inlet 424 and outlet 426 manifolds may be reversed and thus, the flow may be reversed. The surface of the channel 420 provides a radiant heating surface, as described above with respect to the other versions of the heater. The channel 420 may have virtually any type of cross-section such as circular, square, rectangular, oval or the like. Preferably, the channel 420 has a circular cross-section with a uniform diameter and is tubular; i.e., is not an open channel.

As shown in FIGS. 5A-5C, this version also comprises a plurality of adjustable burners 432A, 432B, 432C, 432A', 432B', 432C'. The adjustable burners 432A, 432B, 432C, 432A', 432B', 432C' are similar to those described above but are mounted on an end walls 415, 415' of the heater 418 rather than on the floor 422. As shown in FIG. 5B, there are preferably eight burners, however, more or less burners may be included. The burners may be arranged in a 2×4×2 arrangement. As shown in FIG. 5B, four middle burners 432B are disposed in a substantially vertical line, down the middle of the U-shaped channel 420. The line of burners 432B is about equidistant from the left-side portion 420L and the right-side portion 420R. Two burners 432A are disposed in a substantially vertical line left of the left-side portion 420L but they may be staggered or off-set. Two burners 432C are disposed in a substantially vertical line right of the right-side portion 420R of the U-shaped channel 420. Other arrangements may be used. For example, the burners 432A-432C, 432A'-432C' may be arranged in a 3×4×1, a 4×4×2 or a 1×5×3 configuration. The location and the number of burners and their arrangement may be staggered and optimized for process design reasons.

FIG. 5B shows only one end wall 415 of this heater 418. The opposing end wall 415', shown in FIGS. 5A and 5C, preferably has corresponding burners; in other words the same number of burners, in the same arrangement. Put another way, the opposing end wall 415' is a mirror image of the end wall 415 shown in FIG. 5B.

FIGS. 5A and 5C show a top plan view and, therefore, show only the top burners of 432A, 432B, 432C, and 432A', 432B', 432C'. In other words, they show the burners disposed closest to ceiling 450 (FIG. 5B). However, it will be understood that the flames from the remaining, lower, burners behave similarly as the top burners shown in FIGS. 5A and 5C. As shown in FIGS. 5A and 5C, the adjustable burners 432A, 432B, 432C, 432A', 432B', 432C' produce flames 434A, 434B, 434C, 434A', 434B', 434C' having a body 436A, 436B, 436C, 436A', 436B', 436C' and a tip 438A, 438B, 438C, 438A', 438B', 438C'. The flames 434A, 434B, 434C, 434A', 434B', 434C' extend substantially parallel with respect to the floor 422, in substantially the same horizontal plane. The flames 434B, 434B' from the middle burners 432B, 432B' extend between the left-side portion 420L and right-side portion 420R of the channel 420 but above the middle portion 420M (FIG. 5B).

FIG. 5A shows the burners 432A, 432B, 432C on wall 415 and burners 432A', 432B', 432C' on wall 415' in the first or neutral position. In this position, the burners 432A, 432B, 432C, 432A', 432B', 432C' are not angled with respect to the horizontally-extending plane of the end walls 415, 415'. Due to the alignment of burners 432A, 432B, 432C, 432A', 432B', 432C' on the two end walls (i.e., the walls being a "mirror image" with respect to the burner placement), flames 436B, 436B' from middle burners 432B, 432B' often combine in a flame overlap portion 446. This causes excessive heat on at least a group of channels 448 near the middle of the heater 418. The flames 434A, 434A', 434C, 434C' from end burners 432A, 432A', 432C, 432C' often curl toward the group of channels 448 due to rotational box currents (not shown) in the heater 418. In particular, flames 434A, 434A', 434C, 434C' curl toward the left and right side portions of these channels 448, which are the same as for the channel shown in FIG. 5B. These flames 434A, 434A', 434C, 434C' also can excessively heat the group of channels 448.

FIG. 5C shows the burners 432A-432C, 432A'-432C', tilted to compensate for the rotational box currents (not shown). The burners 432A, 432A', 432B, 432B', 432C, 432C' may be tilted from about 1 degree to about 30° with respect to a horizontal plane of the end walls 415, 415'. Preferably, the burners 432A, 432A', 432B, 432B', 432C, 432C' are tilted about 7 degrees to about 15 degrees in either direction (i.e., in the positive or negative direction, as described above with respect to other versions of the heater.) Preferably, corresponding burners are tilted the same amount but in opposite directions. For example, one set of middle burners 432B may be tilted −7 degrees and the opposing set of middle burners 432B' may be tilted +7 degrees. Flame bodies 436B, 436B' and flame tips 438*b*, 438*b*' are now off-set with respect to their position shown in FIG. 5A. This way, flames 434B, 434B' will not overlap and there is less likelihood of the group of channels 448 being subject to excessive heat.

Burners 432A, 432A' are tilted so that their flame tips 438A, 438A' are closer to the refractive walls 414 than when these burners 432A, 432A' are in the first position. In the adjusted position, burners 432A, 432A' may even contact the refractive walls 414. Similarly, burners 432C, 432C' are tilted so that their flame tips 438C, 438C' are closer to the refractive walls 414 than when these burners 432C, 432C' are in the first position. In the adjusted position, burners 432C, 432C' may even contact the refractive walls 414. In other words flames 434A, 434A', 434C, 434C' now curl away from the group of channels 448 rather than toward them. As such, flames 434A, 434A', 434C, 434C' and their flame tips 438A, 438A', 438C, 438C' are no longer adjacent or close to the group of shaped channels 448. This reduces the likelihood that the group of channels 448 will be subject to excessive heat or will be impinged. Further, positioning the flames 434A, 434A', 434C, 434C' closer to the refractive walls 414 heats the refractive walls 414, which provides more uniform radiating heat in the heater 418. In addition, heating the refractive walls 414 reduces the rotational box currents due to elimination of temperature differences between the wall and the remainder of the heater 418.

Figure 6A:
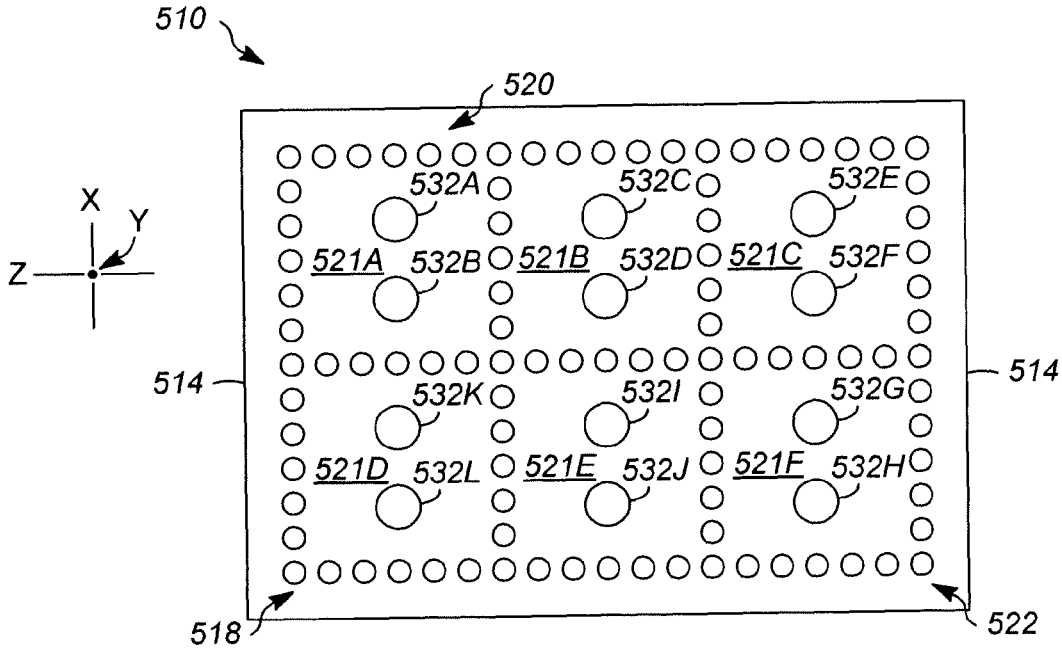
FIG. 6A is a top plan view of another version of a heater having a plurality of adjustable burners and a plurality of serpentine-coil-type channels, with the adjustable burners in the neutral position.
Figure 6B:
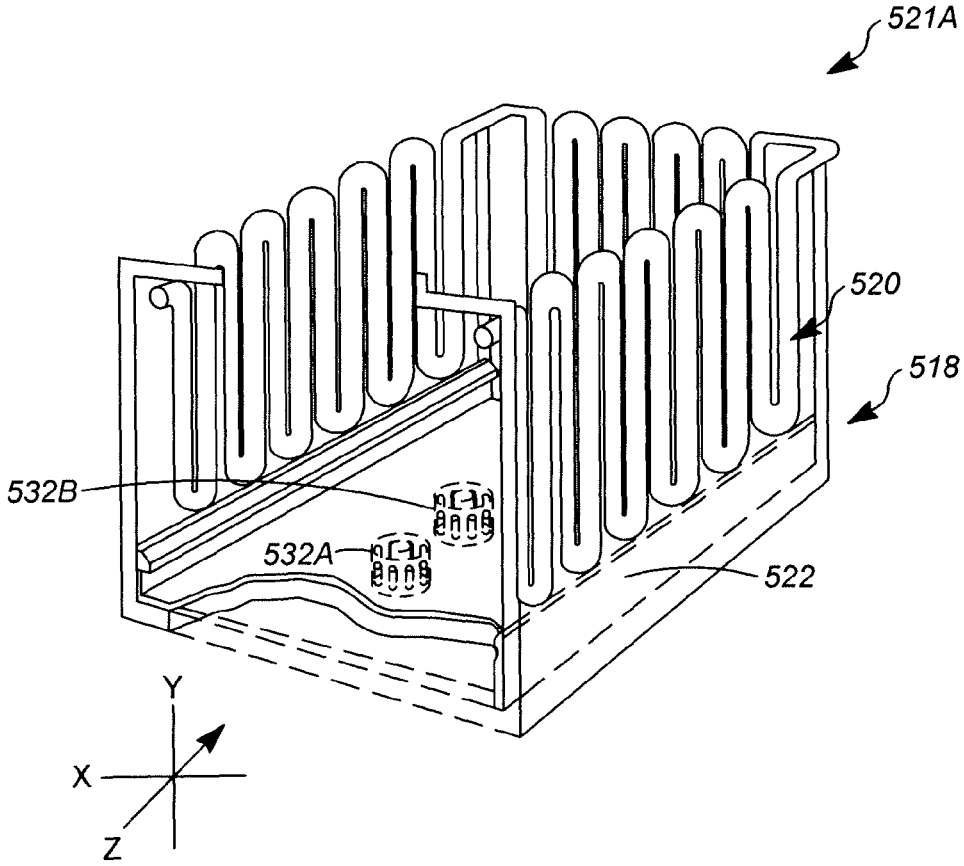
FIG. 6B is a perspective view of one of the subsections shown in FIG. 6A.

FIGS. 6A-6D show another version of a heater 518. Like the heaters shown in FIGS. 1C-4B, a plurality of adjustable burners 532A-532L are positioned on the floor 522 or base of the heater and produce flames (not shown) that extend upward in the vertical direction (i.e., they are bottom-firing). As in the versions above, adjustable burners 532A-532L may be situated in a refractory or masonry base 522. However, unlike the previously-described versions of the heater, the at least one channel in this version is a serpentine-type channel (FIG. 6B). As shown in FIG. 6B, the channel 520 extends vertically from the base or floor 522 and, therefore, is substantially parallel to the direction of flames (not shown) from adjustable burners 532A-532L. However, as shown in FIG. 6B, instead of having an arbor or U-shape, the channel portions are undulating; i.e., the vertically-extending portions are connected by a U-bend portion. A process stream (not shown) enters into inlet manifold (not shown) moves through undulating portion and then moves through outlet manifold (not shown).

Figure 6C:
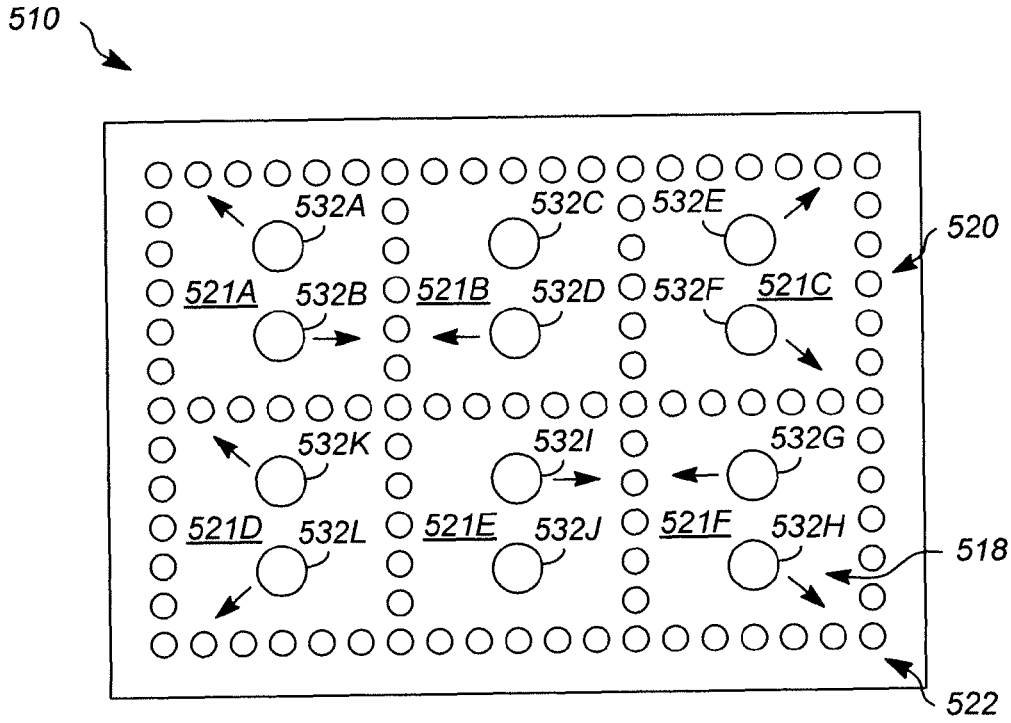
FIG. 6C is a top plan view of the heater shown in FIG. 6A with at least some of the adjustable burners in an adjusted position.

As shown in FIGS. 6A and 6C, a plurality of channels each having multiple undulations, are positioned along the perimeter of the heater 518. Additional channels running perpendicular to the perimeter channels define at least one subsection within the heater. In other words, the channels form a grid. Preferably, the channels define six (6) subsections 521A-521F of the grid. However, the channels may define more or less subsections.

As shown in FIGS. 6A and 6C, the adjustable burners 532A-532L are positioned within each subsection 521A-521F of the heater 518. Preferably, two adjustable burners are positioned within each subsection. However, more or less burners may be included in each subsection. Preferably, the adjustable burners in each subsection are substantially aligned in the z-direction, however, they may be offset. Preferably, three adjustable burners are aligned along the x-direction. However, they also may also be offset.

Figure 6D:
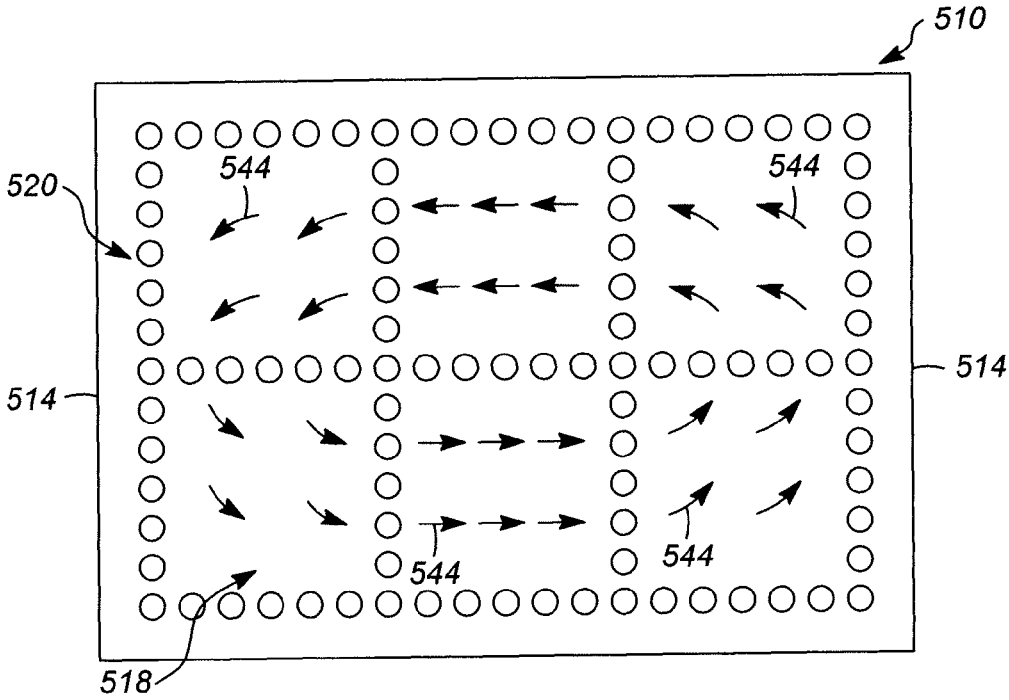
FIG. 6D is a top plan view of the heater shown in FIG. 6A with the adjustable burners removed for clarity and showing at least one current.

FIG. 6D shows flue gas box currents 544 that typically occur in a heater 518 such as that shown in FIGS. 6A and 6C. These currents 544 are generally rotational and flow counterclockwise. As such, they may create a "tornado" effect within the heater 518. When the burners 532A-532L are in the first or neutral position as shown in FIG. 6A, these currents 544 blow flames (not shown) from the adjustable burners 532A-532L toward channels.

FIG. 6C shows the burners 532A-532L adjusted to compensate for these rotational box currents 544. Adjusting the burners 532A-532L so that the flames are tilted, rotated or positioned to substantially oppose these currents, puts the flames relatively central to the channels, as shown above with respect to other versions. In other words, the flames may be tilted into and against the rotational direction of the currents. In the adjusted position, the flames (not shown) break-up rotational currents 544. In addition, the position of the burners 532A-532L and the currents 544 position the flame tips and intense heat spots (not shown) substantially equidistant between opposite sets of channels. This prevents overheating and impingement of the channels.

FIG. 6C shows preferred positions of the adjustable burners 532A-532L, however, the burners 532A-532L may be positioned otherwise. In particular, burners 532B, 532D, 532G, 5321 are adjusted in the x-y direction only. In other words, like the adjustable burners shown in FIGS. 1A and 1B, these adjustable burners are tilted with respect to an imaginary horizontal ground plane only. Burners 532A, 532C, 532F, 532H, 532K, 532L are titled with respect to the X, Y and Z axis. Burners 532C and 532 *j* remain in the first or neutral position.

Burners 532B, 532D, 532G, 5321 may be tilted from about 1 degree to about 30 degrees or about −1 degree to about −30 degrees. Preferably, burners 532B, 532D, 532G, 5321 are tilted about 7 degrees to about 15 degrees or about −7 degrees to about −15 degrees, with respect to the horizontal ground plane. Burners 532A, 532C, 532F, 532H, 532K, 532L may be adjusted to about 1 degree to about 50 degrees with respect to the x and z directions or about −1 degree to about −50 degrees. Preferably, burners 532A, 532C, 532F, 532H, 532K, 532L are about 45 degrees or −45 degrees with respect to the x and z directions. Preferably, burners 532A, 532C, 532F, 532H, 532K, 532L are about 1 degree to about 30 degrees or about −1 degree to about −30 degrees with respect to the horizontal ground plane. Preferably, burners 532A, 532C, 532F, 532H, 532K, 532L are tilted about 7 degrees to about 15 degrees or about −7 degrees to about −15 degrees, with respect to the horizontal ground plane.

Figure 7A:
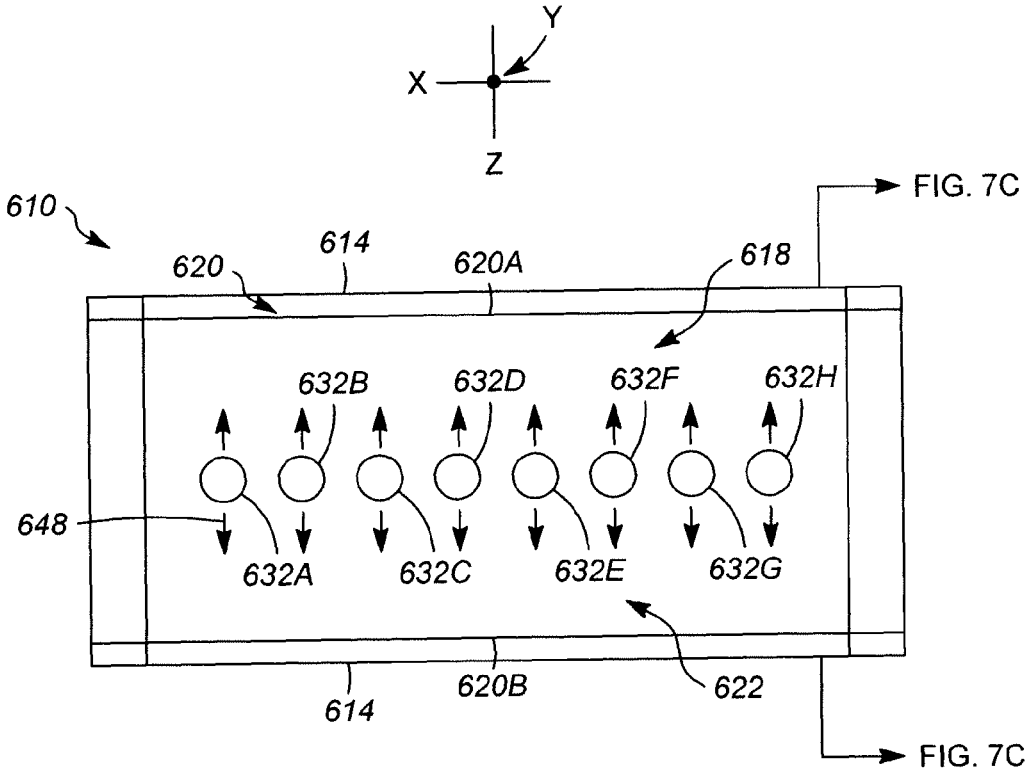
FIG. 7A is a top plan view of another version of a heater having a plurality of adjustable burners and at least two horizontally-extending channels, with the adjustable burners in the neutral position.
Figure 7B:
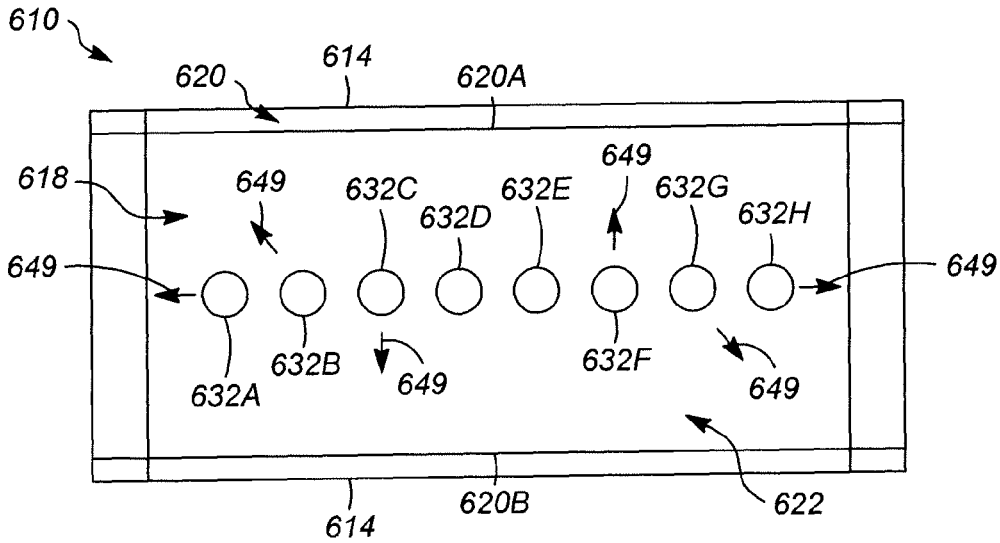
FIG. 7B is a top plan view of the heater shown in FIG. 7A with at least some of the adjustable burners in an adjusted position.
Figure 7C:
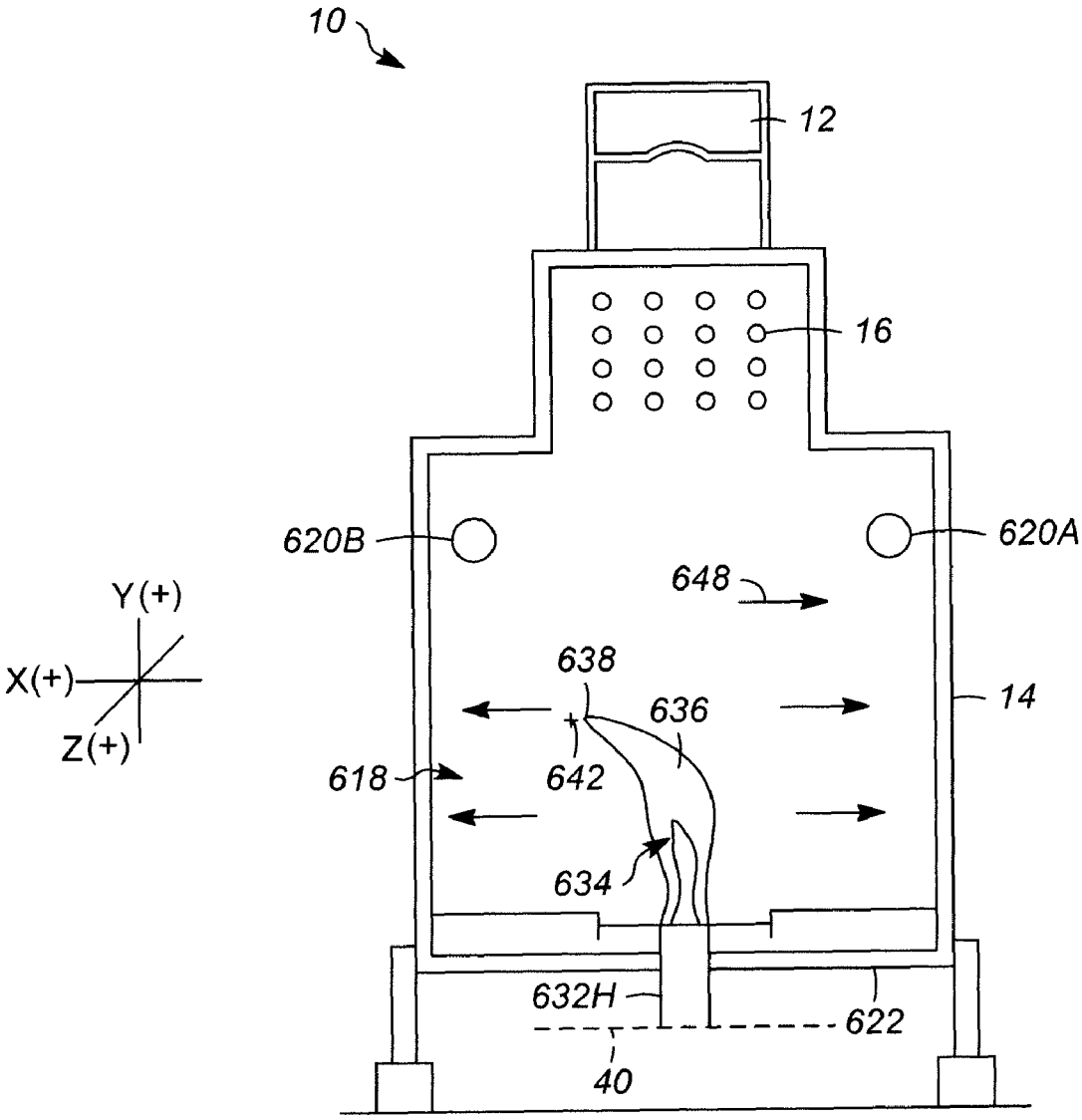
FIG. 7C is a front plan view of the heater shown in FIG. 7A.

FIGS. 7A-7C show another version of a heater 618. Like the heaters shown in FIGS. 1C-6D, adjustable burners 632A-632H are positioned on the floor 622 of the heater 618 and produce flames (FIG. 7C) that extend upward in the vertical direction (i.e., they are bottom-firing). As in the versions above, adjustable burners 632A-632H may be situated in a refractory or masonry base 622.

Unlike the previously-described versions of the heater, this version comprises a plurality of horizontally-extending channels 620. Preferably, the heater 618 comprises at least two channels 620A, 620B extending substantially parallel with respect to the base 622 or ground plane. The channels 620A, 620B may have virtually any cross-section such as oval, circular, square, rectangular, etc. Preferably, the channels 620A, 620B have a closed, circular cross-section. The channels 620A, 620B carry a process stream (not shown) and provide a radiant heating surface (not shown), as provided above with respect to the previously-described versions. In particular, a process stream enters into inlet manifold (not shown) moves through a central portion of the channels 620A, 620B and then moves through outlet manifold (not shown).

A plurality of adjustable burners 632A-632H are positioned between the channels. Preferably, eight adjustable burners 632A-632H extend along the length of the channels 620A, 620B (i.e., along the x-direction), however, more or less burners may be included. Preferably, the adjustable burners 632A-632H are substantially aligned in the x-direction and are positioned substantially equidistant from the channels with respect to the z-direction.

FIG. 7A shows the adjustable burners 632A-632H in the first or neutral position. In this position, flue gas currents 648 blow flames toward either channel 620A or 620B. This produces intense heat spots close to either 620A or 620B, as described above with respect to FIGS. 1A and 1B.

FIG. 7C shows adjustable burner 632H in the first position. In this position, the burner 632H is substantially horizontal with respect to the substantially horizontal imaginary ground plane 40. The body 636 of the flame 634 is disposed substantially central with respect to channels 620A and 620B. However, the tip 638 of the flame 634 may not be positioned centrally, but may be positioned more toward either 620A or 620B. In other words, tip 638 of the flame 634 may be disposed off-center with respect to 620A or 620B. This may be due to the lateral flue box currents. The tip 638, therefore, may produce a relatively intense heat spot 642 adjacent 620B. As shown in FIG. 7C, currents 748 cause flame 634 to lean toward 620B. This produces intense heat spot 642 close to 620B, which may damage or impinge this channel. Tilting the burner to a second position centers intense heat spot 642, as described above with respect to FIGS. 1A and 1B. In the neutral position shown in FIG. 7C, flame 634 could lean toward 620A if currents 648 push flame 634 more toward the right-side.

FIG. 7B shows the adjustable burners 632A-632H adjusted to compensate for the lateral flue gas box currents 648 within the heater. Adjusting the adjustable burners 632A-632H, as shown in FIG. 7B, in particular, firing flames 632A, 632H and 632B, 632G and 632C, 632F, in opposite directions, positions the flames from the respective burners so that they break-up these currents 648. The position of the flame and the currents, position the flame tips and intense heat spots produced by burners 632A-632H, substantially equidistant from the channels 620A, 620B. This substantially equidistant position prevents overheating or impingement of the channels.

Burners 632D, 632E may remain in the neutral position. Burners 632A, and 632*h* are tilted in the x-direction only, with respect to the horizontal ground plane. Burners 632C and 632F are tilted in the z-direction only, with respect to the horizontal ground plane. Burners 632B and 632G are adjusted in the x and z-directions. Burners 632A, and 632*h* may be tilted from about 1 degree to about 30 degrees or −1 degree to about −30 degrees. Preferably, burners 632A, and 632*h* are tilted from about 7 to about 15 degrees or about −1 to about −15 degrees. Burners 632C and 632F may be tilted from about 1 degree to about 30 degrees or −1 degree to about −30 degrees. Preferably, burners 632C and 632F are tilted from about 7 to about 15 degrees or about −1 to about −15 degrees. Burners 632B and 632G may be adjusted to about 1 degree to about 50 degrees with respect to the x and z directions or about −1 degree to about −50 degrees. Preferably, burners 632B and 632G are about 45 degrees or −45 degrees with respect to the x and z directions. Burners 632B and 632G may be about 1 degree to about 30 degrees or about −1 degree to about −30 degrees with respect to the horizontal ground plane. Preferably, burners 632B and 632G are tilted about 7 degrees to about 15 degrees or about −7 degrees to about −15 degrees, with respect to the horizontal ground plane.

As provided above, every burner used in every version of the heater is adjustable. As such, each adjustable burner comprises means for quickly and easily adjusting its position when it is online or in use.

Virtually any means for adjusting the burner may be used as long as the means for adjusting allows the burner to place the flame at various positions relative to the channel and is capable of support the adjustable burners, which weigh anywhere from about 100 pounds to about 2000 pounds. Preferably, the burners each weigh about 500 pounds to about 1500 pounds.

Preferably, the burners 32, 132, 232, 332, 432, 532, 632 may be tilted left and right, forward and backward and in between. For example, in the version shown in FIGS. 1A and 1B, the adjusting means allows the burner 32 to be tilted toward either the left-side vertical portion 20A or the right-side vertical portion 20B while being tilted frontward or rearward (i.e., in the "z" direction).

The adjusting means may allow the burner 32, 132, 232, 332, 432, 532, 632 to be rotated three-hundred and sixty degrees (360°). Rotation means may include any number of bearings and gears or joints such as a ball-and-socket-type joint or a double ball-and-socket-type joint, rotating mounting bracket with pivot, cam-shaft, crank-shaft or the like. Rotation means or revolution means may also include a locking mechanism. Tilting means may include a pivot and lock mechanism or a lever. In addition, the adjusting means may include means for extending the burner 32 upwardly or retracting it downwardly.

The means for adjusting provides also comprises means for locking the adjustable burner 32, 132, 232, 332, 432, 532, 632 in place. Virtually any means may be used for locking the burner 32 in place such as locking screws, teeth, etc. or other elements that provide mechanical interference with the rotation, tilting or pivoting of the burner 32. In addition, adjusting means may include an electromechanical means for adjusting and locking the burner 32 in place.

Figure 8:
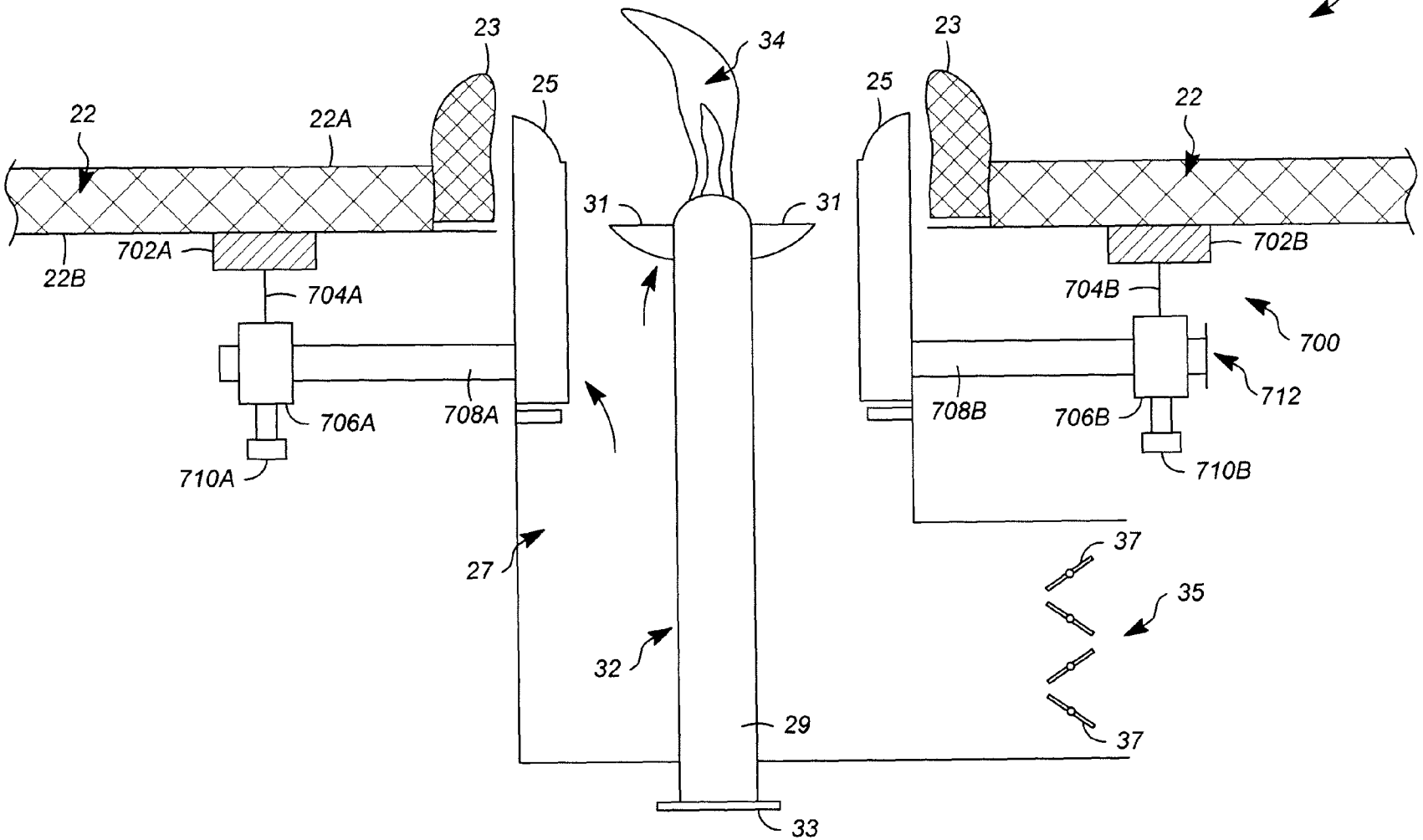
FIG. 8 shows a partial cutaway section of a furnace having a fired burner including another version of at least one adjusting means.

FIG. 8 shows a cutaway section of a portion of a furnace 10 having a fired burner 32 located in a refractory floor or base 22. The burner may be any adjustable burner described herein. In addition, the burner may be located along a wall rather than in a base. The burner 32 includes a version of at least one adjusting means 700. The furnace 10 may be that shown in FIGS. 1A and 1B. However, it will be understood that the burner having adjustment means may be used in other versions of the furnace.

FIG. 8 shows the base 22. The base 22 has first face 22A and an opposing second face 22B. The base 22 also has an opening exposing a plenum or channel 27 containing the burner 32. A flame 34 produced by the burner 32, may extend substantially upward through the opening. At the opening around the perimeter, is refractory packing 23. The burner plenum or chamber 27 extends from the opening downward. The chamber 27 has an opening at one end for allowing the flame 34 from the burner 32 to extend through base 22. The chamber 27 has another opening at another end which operates as an air inlet 35. At air inlet 35 may be a series of dampers 37 as is known in the art. The chamber 27 may be virtually any shape and have virtually any cross-section such as square, rectangular, oval, circular, etc. Between the two opposite ends may be a bend.

Extending upward from the channel 27, toward the opening in the base 22 is at least one burner 32. The burner 32 comprises at least one fuel pipe, in this case a gas pipe 29, which is in communication with at least one fuel source, which is a gas terminal 33. The burner 32 may also be coupled to a burner mounting plate (not shown). Coupled to the gas pipe 29, at the end opposing the gas terminal 33, is at least one flame holder 31 from which flames 34 are emitted from the burner. Within interior walls of the chamber 27 is at least one burner tile 25, which are designed to protect the chamber 27 from extreme heat from the burner.

The adjustment means 700 comprises at least one turntable 702A, 702B attached to the second face 22B of the base 22. Two turntables 702A, 702B, one on each side of the channel 27, may be attached to the second face 22B of the base 22. The turntables 702A, 702B have a first end, which is attached to the base, and a second end attached to a connector. The first end is attached to 22B and is fixed in its position and the second end is rotatable. A bearing surface separates the first end and the second end. The turntables 702A, 702B are capable of rotating 360° in either the clockwise or counterclockwise direction, in the Y-direction. Coupled to the second end of the turntables 702A, 702B and a sleeve 706A, 706B, is a connector 704A, 704B. The connecter 704A, 704B may be a rigid rod. Each sleeve 706A, 706B houses a rotatable support 708A, 708*b*. The rotatable supports 708A, 708*b* are coupled to the burner gas pipe 29. Attached to each sleeve 706A, 706B is a lock nut 710A, 710B for locking a relative position of the rotating support 708A, 708*b*. Also attached to at least one of the rotating support 708A, 708*b* is at least one angle indicator 712 for providing an indication of the relative position of the rotating support 708A, 708*b*.

To adjust the position of the burner 32, at least one turntable 702A, 702B is rotated either clockwise or counterclockwise. Rotation of the at least one turntable 702A, 702B rotates at least one of the rotating members 708A, 708B. Rotating at least one of the rotating members 708A, 708B within sleeve 706A, 706B moves rotating member 708A, 708*b* toward burner gas pipe 29. Contact between rotating member 708A, 708*b* and gas pipe 29 tilts the burner 32. (FIG. 1B.) Rotating at least one turntable 702A, 702B in the opposite direction moves rotating member away from gas pipe 29, which may move burner 32 into the neutral position (FIG. 1A.) The burner 32 may be tilted or rotated in any direction. Which direction depends upon which turntable is rotated and, therefore, which rotating member moves relative to the gas pipe.

In addition, the heaters of the above versions may have at least one sensor (not shown). Preferably, the sensor is positioned on or near the channels, in particular, near portions of the channels that are often damaged due to excessive heat. The sensor is configured to read the temperature on or near the portion of the channel near the sensor. If the sensor reads a temperature that is at or above a pre-determined maximum temperature, the sensor activates the means for adjusting the flame's position so that the flame is moved farther away from the sensor and overheated portion of the channel. Sensors may also be positioned elsewhere and be configured to read ambient conditions such as wind velocity and direction. When the wind velocity meets or exceeds a predetermined velocity, the sensor communicates to the adjusting means to adjust the burner to compensate for the wind. In particular, the sensor may communicate to the adjusting means to move or tilt the burner is a direction opposite to the direction of the wind (i.e., into the wind). The amount of movement or tilt may be based upon the velocity of the wind. Thus, the sensors will allow real-time, automated adjustment of the burner in response to ambient conditions.

The burner may be adjusted automatically, as with the sensor, as described above, or may be adjusted manually but remotely. In particular, a computer (not shown) may be coupled to the adjustable burner. The computer may include software that interacts with adjusting means such that a user can remotely adjust the burner via commands input to the computer. In addition, the computer may be configured to adjust the position of the burner in response to the sensors. In particular, the input may be a set of commands that move the burner in response to pre-determined conditions. For example, the software would allow a user to input a predetermined sensor threshold temperature. The sensor would read the temperature at or near a portion of the channel. If the temperature met or exceeded a predetermined threshold temperature, the sensor would send a signal to the computer. The computer and software would activate adjusting means to move the burner relative to the channel.

Although the heater with at least one burner has been described in terms of exemplary structures, it is not limited thereto. Rather, the appended claims should be construed broadly to include other variants and structures which may be made by those skilled in the art without departing from the scope and range of equivalents. This disclosure is intended to cover any adaptations or variations discussed herein. An apparatus as described above with reference to the foregoing description and appended drawings is hereby claimed.

The invention claimed is:

1. A fired heater for industrial processes comprising:

at least three channels carrying a process stream, each channel having at least one inlet terminal and at least one outlet terminal;

at least three pluralities of burners disposed substantially in a line, each burner producing a flame, the flame configured to heat the channel, wherein at least two burners in each plurality are configured to be adjustable between a neutral position and an adjusted position; wherein in the adjusted position, the burners on the ends of the lines of burners are tilted relative to a mounting surface and at least one burner between the burners on the ends remains in the neutral position; and wherein the flame produced by the burner between the burners on the ends extends lower in height than the flames produced by the burners on the ends of the lines.

2. The heater of claim 1, wherein an additional burner is configured to tilt relative to a mounting surface.

3. The heater of claim 1, wherein at least one burner is configured to rotate.

4. The heater of claim 1, wherein at least one burner is configured to be locked into position in the adjusted position.

5. The heater of claim 1, wherein at least one channel comprises a left portion, a right portion and a middle portion and wherein in the adjusted position, a tip of at least one flame is disposed substantially central with respect to the left portion, right portion and middle portion.

6. The heater of claim 1, wherein in the adjusted position, at least a portion of at least one flame from a burner is positioned closer to at least one wall of the heater to heat the wall than when the burner is in the neutral position.

7. The heater of claim 1 wherein the channels are arranged in a grid and wherein at least two burners are positioned within each section of the grid.

8. The heater of claim 7, wherein in the adjusted position, the burners are positioned so that the flames substantially oppose rotational air currents within the heater.

9. The heater of claim 1, wherein one plurality of burners is disposed on a first wall of the heater and one plurality of burners is disposed on a second wall of the heater, the second wall opposing the first wall, the plurality of channels disposed between the first wall and the second wall, wherein in the adjusted position, every burner except one burner between the ends of the lines is tilted relative to the walls.

10. The heater of claim 9, wherein the pluralities of burners comprise at least a first set of burners, a second set of burners and a third set of burners on the first wall and a corresponding first set of burners, second set of burners and third set of burners on the second wall, wherein in the adjusted position, the first set of burners, second set of burners and third set of burners, except for one burner between the ends of the lines of each set, are tilted relative to the first wall and wherein the corresponding first set of burners, second set of burners and third set of burners, except for one burner between the ends of the lines of each set, are tilted relative to the second wall.

11. The heater of claim 10, wherein the second set of burners and third set of burners, except for one burner between the ends of the lines of each set, are tilted relative to the second wall to the same degree as the burners on the first wall but in an opposing direction.

12. The heater of claim 1, wherein the pluralities of burners are disposed on at least one wall of the heater.

13. The heater of claim 1, wherein the channels extend substantially parallel to a ground plane, the channels positioned on opposing sides of at least one of the pluralities of burners.

14. The heater of claim 1, wherein in the adjusted position, the burners are positioned to break-up lateral air currents within the heater.

15. A fired heater comprising:

a channel carrying at least one stream of material;

a base and at least one wall, the base and at least one wall providing at least one burner mounting surface;

a chamber within at least one mounting surface;

an adjustable burner comprising at least one fuel pipe in communication with at least one fuel source, the burner configured to produce a flame from an end of the fuel pipe, the adjustable burner adjacent the channel;

at least one burner adjustment mechanism comprising:

at least one rotatable turntable coupled to at least one mounting surface;

at least one connector;

at least one rotatable support;

at least one angle indicator;

wherein the at least one connector is coupled to the turntable and the at least one rotatable support, wherein the at least one rotatable support is coupled to the burner, and wherein rotation of the at least one turntable adjusts the position of the adjustable burner.

16. The heater of claim 15, further comprising at least one means for automatically activating the burner adjustment mechanism and at least one sensor in communication with the channel, the automatic means in communication with the burner adjustment mechanism and the temperature sensor, wherein the means for automatically activating the burner adjustment mechanism automatically adjusts the position of the burner when the temperature sensor senses a predetermined temperature.

17. The heater of claim 15, wherein the at least one turntable comprises a bearing surface.

18. The heater of claim 15, wherein the connector is rigid.

19. The heater of claim 15, wherein rotation of the at least one turntable tilts the adjustable burner relative to the mounting surface.

20. A fired heater comprising:

a channel carrying at least one stream of material;

a base and at least one wall, the base and at least one wall providing at least one burner mounting surface;

a chamber within at least one mounting surface;

an adjustable burner comprising at least one fuel pipe in communication with at least one fuel source, the burner configured to produce a flame from an end of the fuel pipe, the adjustable burner adjacent the channel;

at least one burner adjustment mechanism comprising:

at least two rotatable turntables coupled to at least one mounting surface, said at least two turntables disposed on opposing sides of the channel;

at least one connector;

at least one rotatable support;

wherein the at least one connector is coupled to the turntable and the at least one rotatable support, wherein the at least one rotatable support is coupled to the burner, and wherein rotation of the at least one turntable adjusts the position of the adjustable burner.

21. The heater of claim 20, further comprising at least one means for automatically activating the burner adjustment mechanism and at least one sensor in communication with the channel, the automatic means in communication with the burner adjustment mechanism and the temperature sensor, wherein the means for automatically activating the burner adjustment mechanism automatically adjusts the position of the burner when the temperature sensor senses a predetermined temperature.

22. The heater of claim 20, wherein the at least one turntable comprises a bearing surface.

23. The heater of claim 20, wherein the connector is rigid.

24. The heater of claim 20, wherein rotation of the at least one turntable tilts the adjustable burner relative to the mounting surface.

* * * * *